US007413301B2

(12) United States Patent
Niimi et al.

(10) Patent No.: US 7,413,301 B2
(45) Date of Patent: Aug. 19, 2008

(54) INKJET PRINTING APPARATUS WITH MULTIPLE PLATENS

(75) Inventors: Akiko Niimi, Kasugai (JP); Katsuya Watarai, Ena (JP); Kousuke Fukaya, Chiryu (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 11/369,695

(22) Filed: Mar. 7, 2006

(65) Prior Publication Data

US 2006/0152568 A1 Jul. 13, 2006

Related U.S. Application Data

(62) Division of application No. 10/799,262, filed on Mar. 12, 2004, now Pat. No. 7,040,748.

(30) Foreign Application Priority Data

Mar. 13, 2003 (JP) ..... 2003-068271
Mar. 25, 2003 (JP) ..... 2003-081837
Mar. 27, 2003 (JP) ..... 2003-087044

(51) Int. Cl.
*B41F 15/18* (2006.01)

(52) U.S. Cl. ..... 347/104; 101/126; 101/474; 38/110; 38/135

(58) Field of Classification Search ..... None
See application file for complete search history.

(56) References Cited

U.S. PATENT DOCUMENTS 4,031,825 A * 6/1977 Jaffa ..... 101/126
4,315,461 A * 2/1982 Harpold ..... 101/126
4,753,164 A * 6/1988 Barnes et al. ..... 101/126
4,846,058 A * 7/1989 Farris ..... 101/126
4,875,268 A * 10/1989 Szarka ..... 101/126
5,090,313 A * 2/1992 Chapman ..... 101/126
5,107,758 A * 4/1992 Withers ..... 101/126
6,095,628 A 8/2000 Rhome

FOREIGN PATENT DOCUMENTS

| | | |
|---|---|---|
| JP | 11227171 | 8/1999 |
| JP | 2002019093 | 1/2002 |
| JP | 2002154247 | 5/2002 |
| JP | 2002361847 | 12/2002 |

* cited by examiner

*Primary Examiner*—Jill E. Culler
(74) *Attorney, Agent, or Firm*—Day Pitney LLP

(57) ABSTRACT

An inkjet type fabric printing apparatus is provided with an inkjet head, a platen and a positioning member. The inkjet head reciprocally moves in main scanning direction and auxiliary scanning direction relative to a fabric (e.g., clothes). The platen holds the fabric to extend on a plane parallel with the main scanning direction and the auxiliary scanning direction with a first predetermined distance spaced from the inkjet head. On the positioning member, the fabric is set. The fabric is positioned on the platen in place in a direction parallel with the main scanning direction and the auxiliary scanning direction. The positioning member supports at least one of a neck portion and a shoulder portion of the fabric such that the neck portion and/or a shoulder portion is spaced from the inkjet head by a second predetermined distance.

42 Claims, 32 Drawing Sheets

INKJET PRINTING APPARATUS WITH MULTIPLE PLATENS

This application is a division of application Ser. No. 10/799,262, filed Mar. 12, 2004 now U.S. Pat. No. 7,040,748, which is herein incorporated by reference.

BACKGROUND OF THE INVENTION

The present invention relates to an inkjet printing apparatus for printing on a fabric.

U.S. Pat. No. 6,095,628, the disclosure of which is incorporated herein by reference, discloses an example of such an inkjet printing apparatus. The printing apparatus disclosed in the patent is provided with a platen that is translatable back and forth with respect to a housing and inkjet head thereof. In use, a T-shirt is loaded on the platen, and the platen is indexed rearwardly so as to place the T-shirt beneath the inkjet head of the apparatus. Then the inkjet head reciprocates above the T-shirt while the platen intermittently moves forward to print a desired image onto the T-shirt.

In the conventional inkjet printing apparatus as mentioned above, the position of the T-shirt on the platen should be determined only by visual observation. Thus, the T-shirt cannot be accurately positioned, and thus the image is often printed out of position, resulting in defective products.

SUMMARY OF THE INVENTION

The present invention is advantageous in that an inkjet type printing apparatus is provided, which is capable of printing an image on a fabric accurately at a desired position thereof.

According to an aspect of the invention, there is provided an inkjet type fabric printing apparatus, which is provided with an inkjet head that ejects ink onto a fabric, the inkjet head reciprocally moving in main scanning direction and auxiliary scanning direction relative to the fabric, a platen that holds the fabric to extend on a plane substantially parallel with the main scanning direction and the auxiliary scanning direction with a first predetermined distance spaced from the inkjet head, and a positioning member on which the fabric is set the fabric is positioned on the platen in place in a direction parallel with the main scanning direction and the auxiliary scanning direction, at least one of a neck portion and a shoulder portion being thicker than a portion of the closing spread on the platen, the positioning member supporting the at least one of the neck portion and the shoulder portion of the fabric such that the at least one of the neck portion and a shoulder portion is spaced from the inkjet head by a second predetermined distance at which the at least one of the neck portion and the shoulder portion does not hinder the movement of the inkjet head.

Optionally, the positioning member may be configured to include a guide plate mounted on an undersurface of the platen with a portion thereof being protruded on a front side of the platen which is one end side in the auxiliary scanning direction of the platen.

According to another aspect of the invention, there is provided an inkjet type fabric printing apparatus, which is provided with an inkjet head that ejects ink onto a fabric, the inkjet head reciprocally moving in main scanning direction and auxiliary scanning direction relative to the fabric, a first platen that holds first shape fabric to extend in the main scanning direction and the auxiliary scanning direction to allow the inkjet head to print an image on the first shape fabric, and a second platen that holds second shape fabric which is different from the first shape fabric to extend in the main scanning direction and the auxiliary scanning direction to allow the inkjet head to print an image on the second shape fabric.

In a particular case, the second shape fabric is smaller than the first shape fabric.

Optionally, one end, in the auxiliary scanning direction, of the first platen may be formed to have a V-shaped side. In such a case, at least one of a neck portion and a shoulder portion of the first size fabric can be supported by the V-shaped side such that the first size fabric is positioned on the first platen in place.

Further optionally, one end, in the auxiliary scanning direction, of the second platen may be formed to have a V-shaped side. With this configuration, the second size fabric can be smoothly set on the second platen.

Optionally, the second platen may be configured to be detachably mounted on the first platen. In this case, the first platen may be optionally provided with an indication that indicates a position on the first platen at which the second platen is mounted.

Further, the inkjet type printing apparatus may further include a height adjusting mechanism arranged to support the first platen at a first height and a second height the height adjusting mechanism may be configured such that, when the first platen is supported at the first height, the first shape fabric is held at a predetermined distance spaced from the inkjet head suitable for printing, and when the second platen is mounted on the first platen supported at the second height, the second shape fabric is held at the predetermined distance spaced from the inkjet head.

Further optionally, the second platen may be provided with a sensor that detects presence/absence of fabric on the second platen.

In this case, the inkjet head may be controlled to start printing only when the sensor has detected the presence of a fabric.

According to a further aspect of the invention, there is provided an inkjet type fabric printing apparatus, which includes an inkjet head that ejects ink onto fabric, the inkjet head reciprocally moving in main scanning direction and auxiliary scanning direction relative to the fabric, a first platen that holds first shape fabric to extend in the main scanning direction and the auxiliary scanning direction to allow the inkjet head to print an image on the first shape fabric, and a plurality of second platens, each of which holds second shape fabric which is different from the first shape fabric to extend in the main scanning direction and the auxiliary scanning direction to allow the inkjet head to print an image on the second shape fabric.

Optionally, each of the second platens may be configured to be detachably mounted on the first platen.

The inkjet type printing apparatus may further include a height adjusting mechanism arranged to support the first platen at a first height and a second height. The height adjusting mechanism may be configured such that, when the first platen is supported at the first height, the first shape fabric is held at a predetermined distance spaced from the inkjet head suitable for printing, and when the second platen is mounted on the first platen supported at the second height, the second shape fabric is held at the predetermined distance spaced from the inkjet head.

Furthermore, the inkjet type printing apparatus according may further include a controller that operates the inkjet head to execute printing. The controller may include a memory for storing images to be printed on fabric set on the second platens. With this configuration, the controller may receive a single image from an external apparatus, copy the received image to locations on the memory corresponding to the plurality of second platens, and then operates the inkjet head according to the data stored in the memory to print the copied images on the fabric set on each of the plurality of second platens.

Optionally, the plurality of second platens may include at least one pair of second platens. In this case, each of the at least one pair of second platens may hold a pair of pieces of fabric to be used in pairs.

In a particular case, the pair of pieces of fabric to be used in pairs may be a pair of gloves or a pair of socks.

Still optionally, the inkjet type printing apparatus may further include a controller that operates the inkjet head to print images. The controller may include a memory for storing images to be printed on the second size fabric. The controller may receive a single image from an external apparatus, copy the received image to a location on the memory corresponding to one of the pair of the second platens while copying a mirror image of the received image to a location on the memory corresponding to the other one of the pair of second platens, and then control the inkjet head, according to the data stored in the memory, to print on the pair of pieces of second shape fabric held by the pair of second platens.

According to a further aspect of the invention, there is provided an inkjet type fabric printing apparatus for printing an image on a predetermined area of a fabric. The printing device is provided with an inkjet head that ejects ink, the inkjet head reciprocally moving in main scanning direction and auxiliary scanning direction relative to the fabric, a platen that holds the fabric to extend on a plane substantially parallel with the main scanning direction and the auxiliary scanning direction with a first predetermined distance spaced from the inkjet head, and a positioning portion integrally formed on the platen, the positioning portion supporting the a reference portion of the fabric such that the fabric is held on the platen in place in a direction parallel with the main scanning direction and the auxiliary scanning direction. The reference portion is formed to be thicker than the other portion including the predetermined area, and the positioning portion supports the fabric such that the reference portion is spaced from the inkjet head by a second predetermined distance at which the reference portion does not hinder the movement of the inkjet head.

BRIEF DESCRIPTION OF THE ACCOMPANYING DRAWINGS

Figure 1:
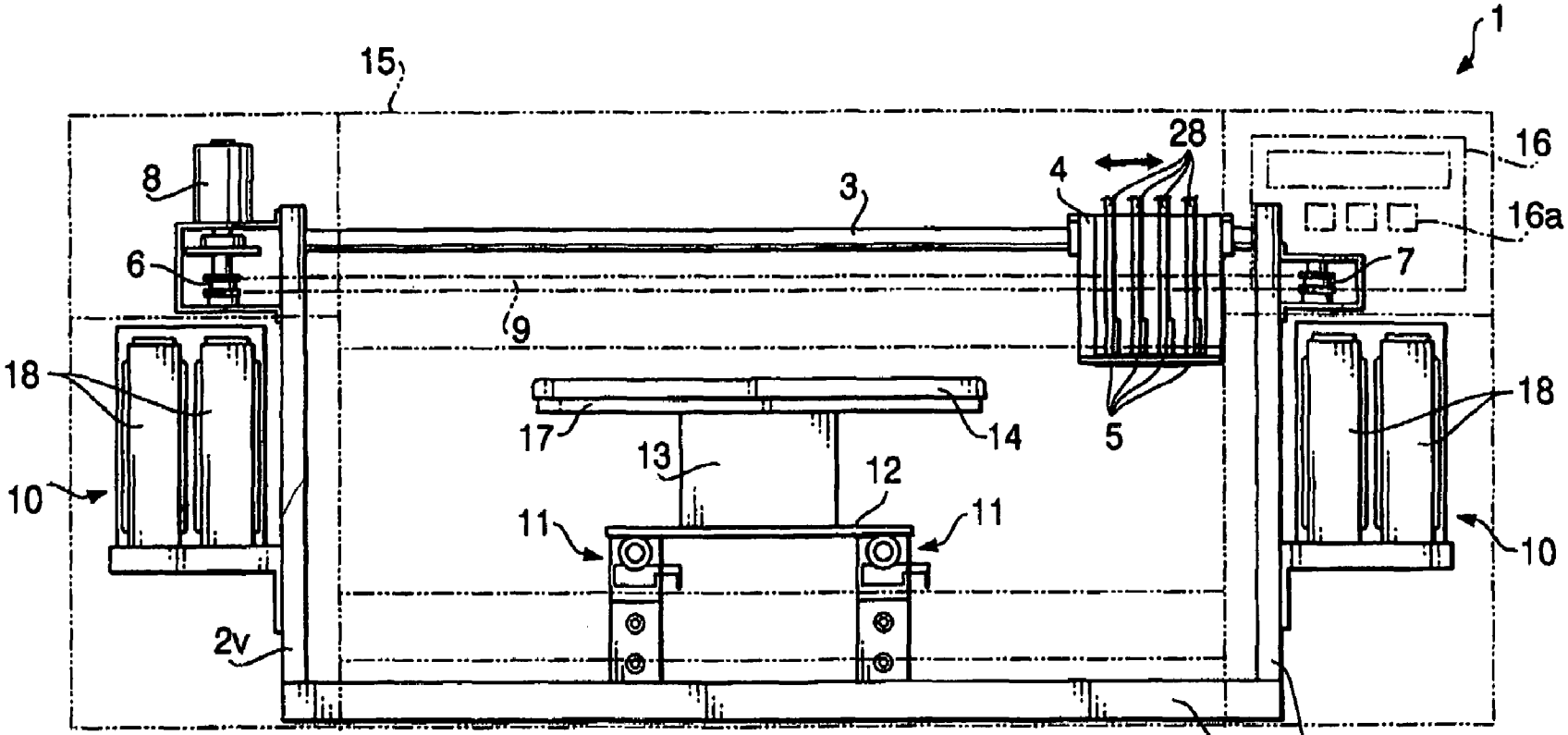
FIG. 1 is a front view of a fabric printing apparatus according to a first embodiment of the invention.
Figure 5:
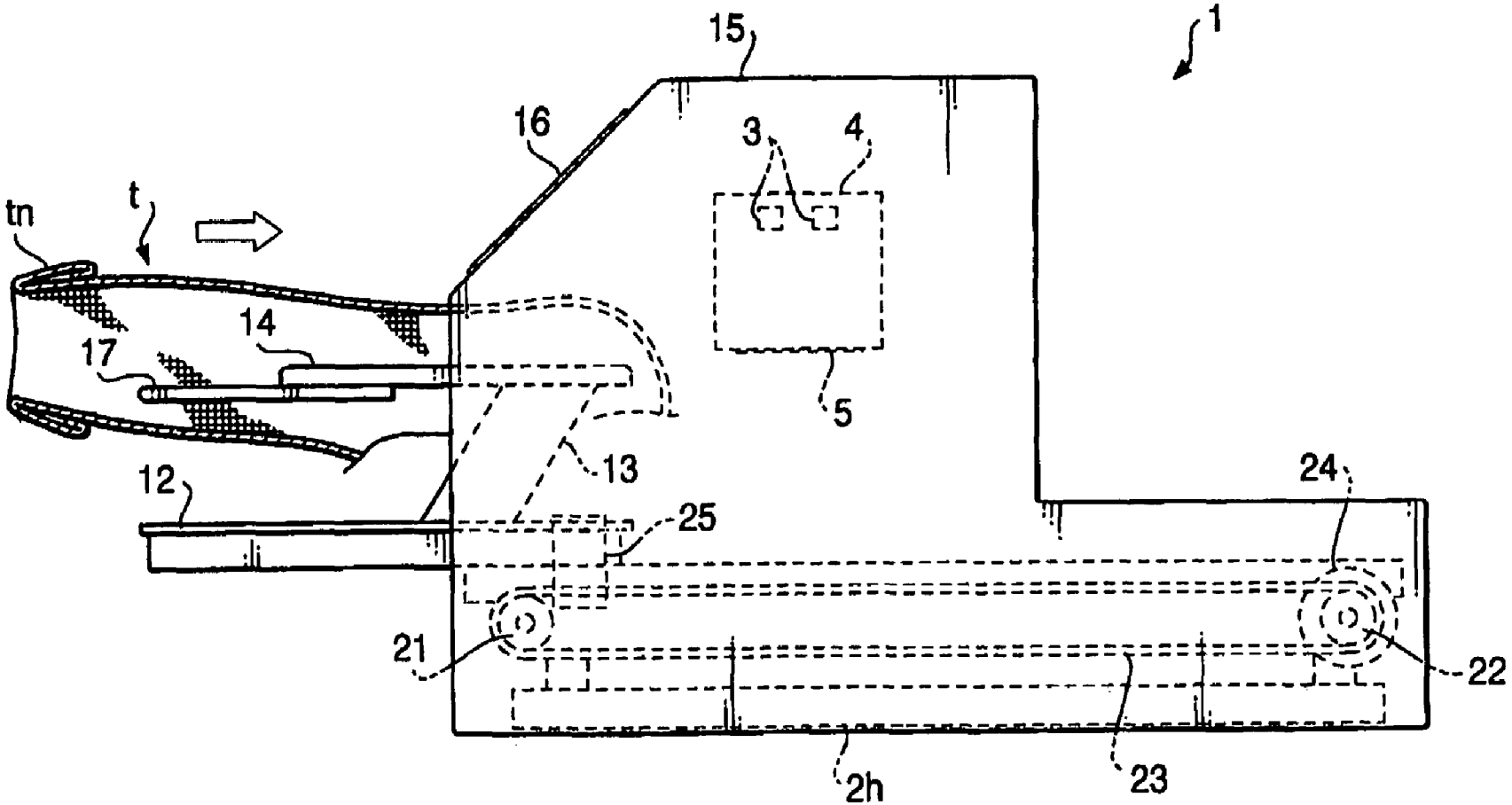
Figure 6:
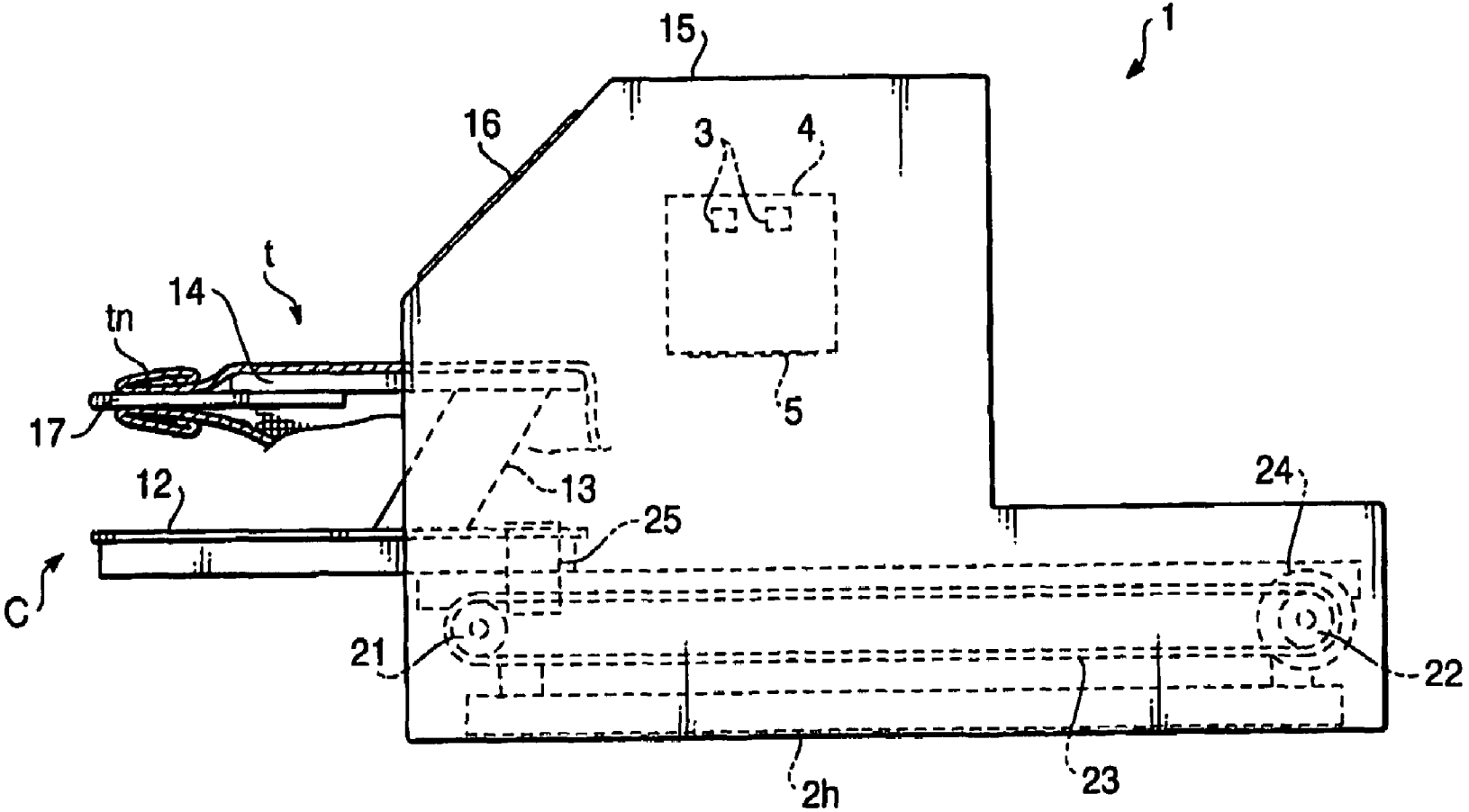
Figure 8A:
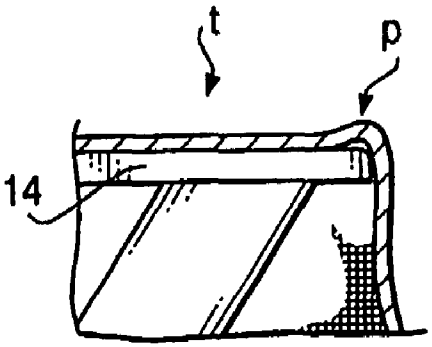
Figure 8B:
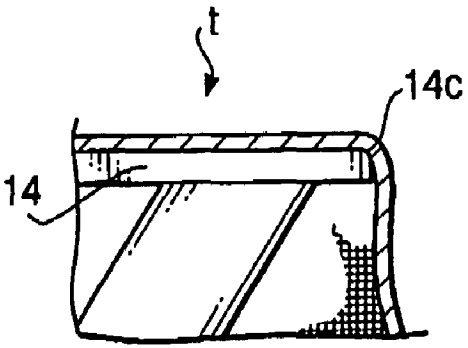
Figure 7:
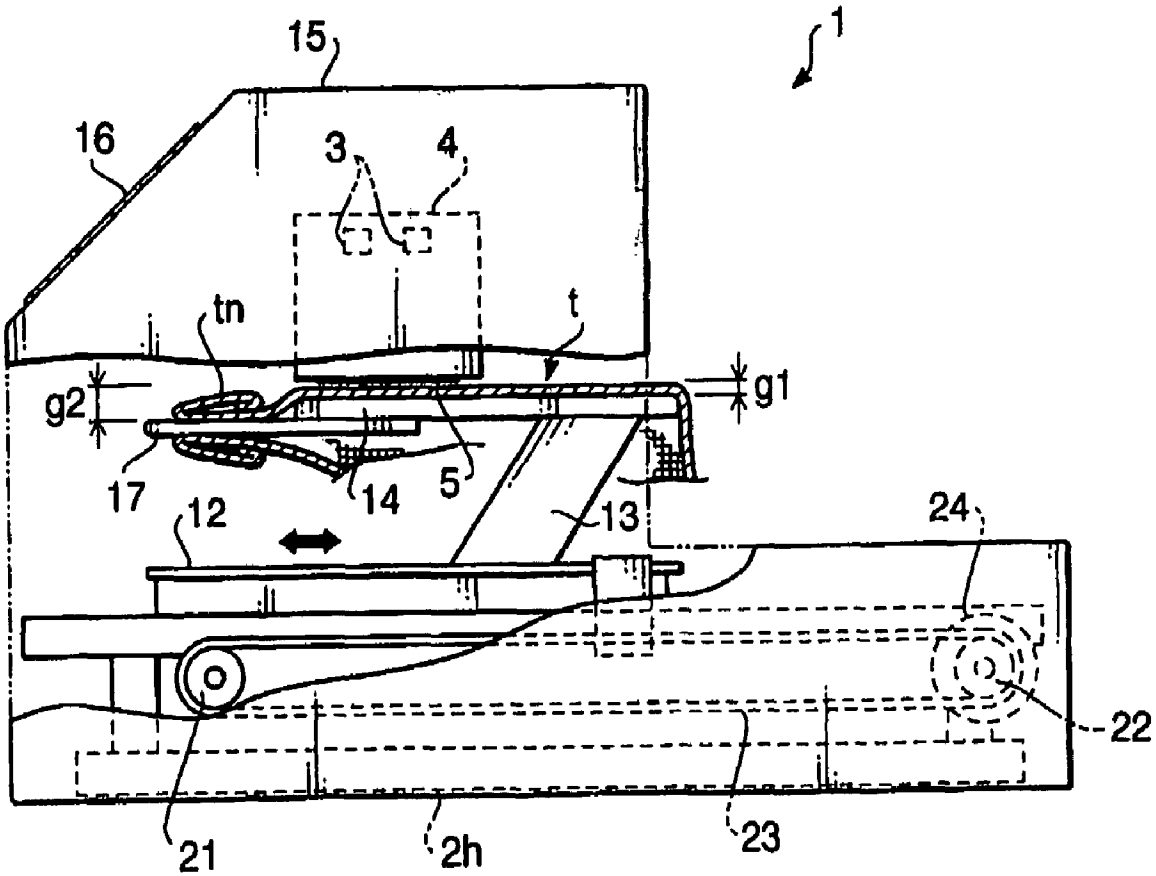
Figure 9:
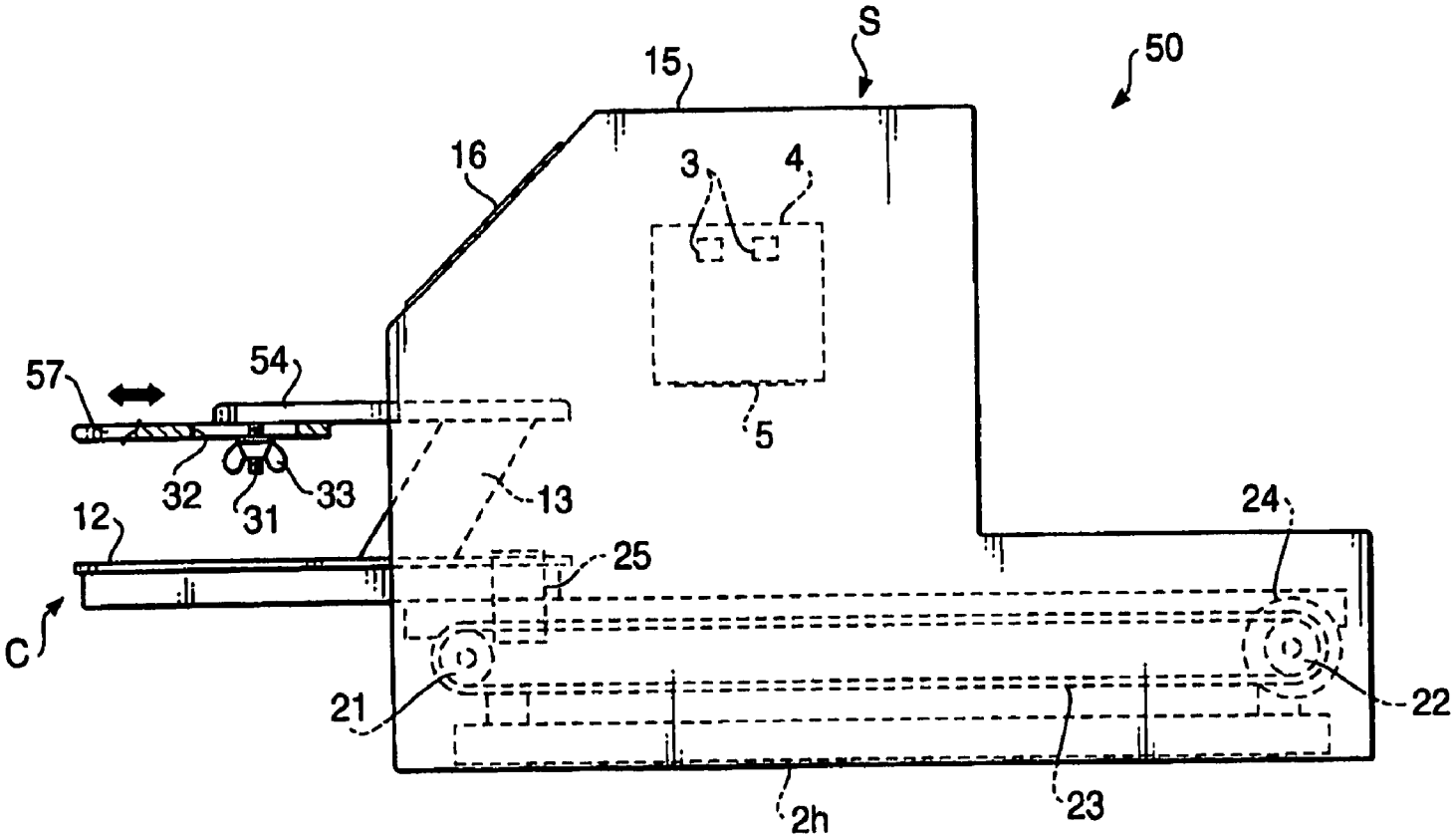
Figure 10:
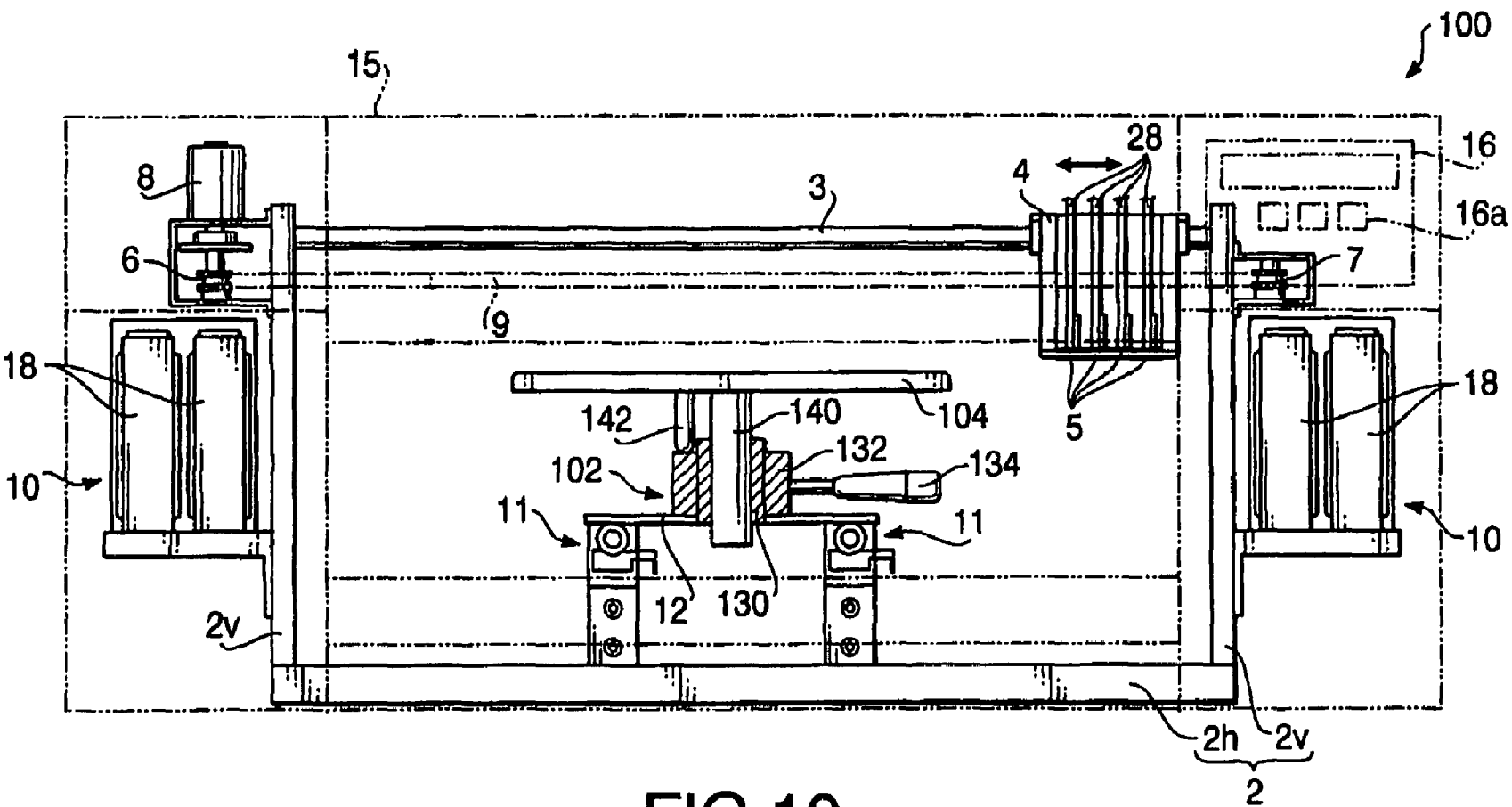
Figure 11:
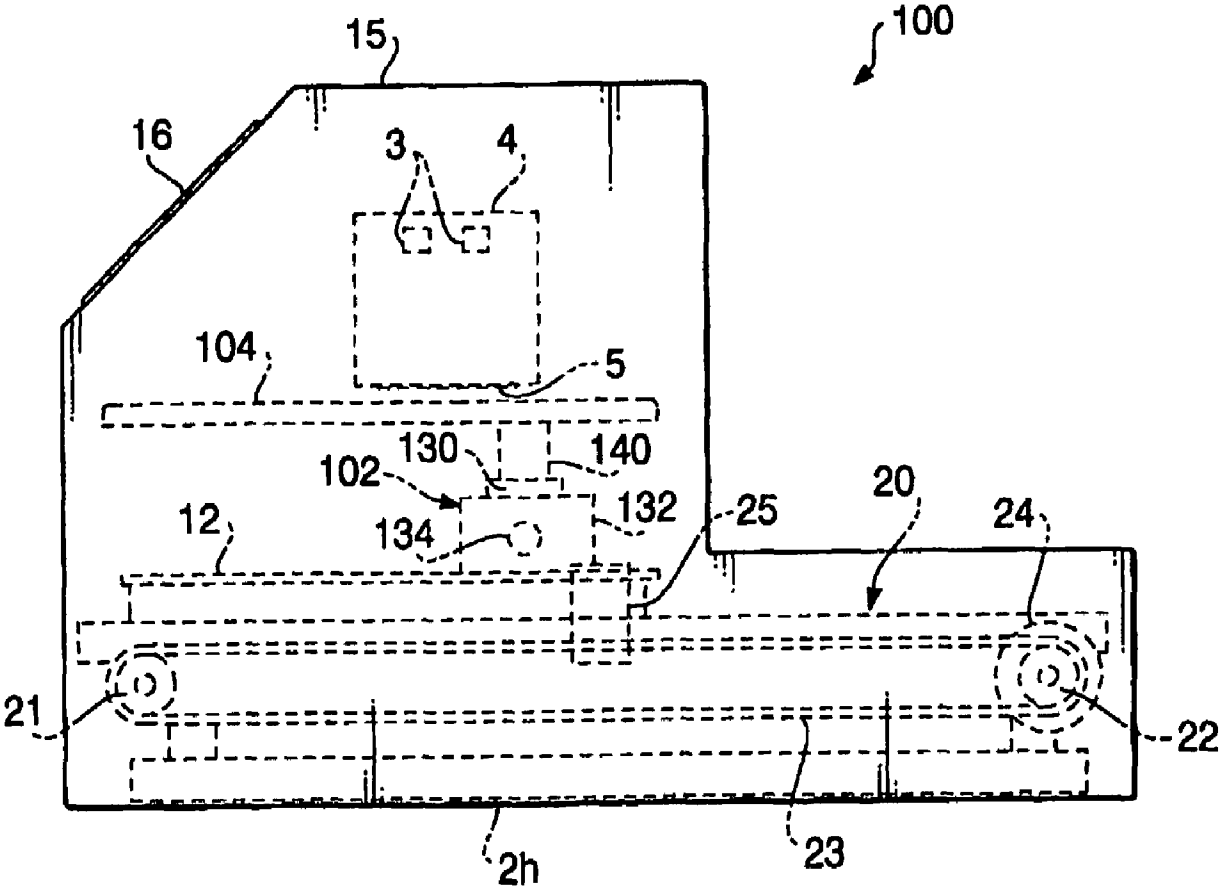
Figure 12:
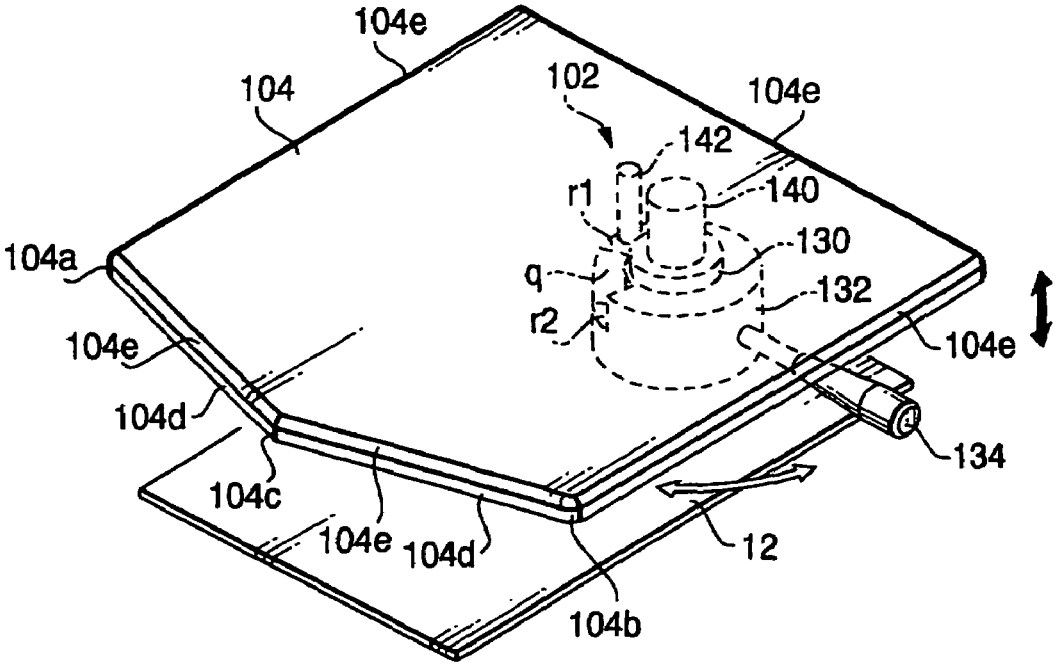
Figure 13:
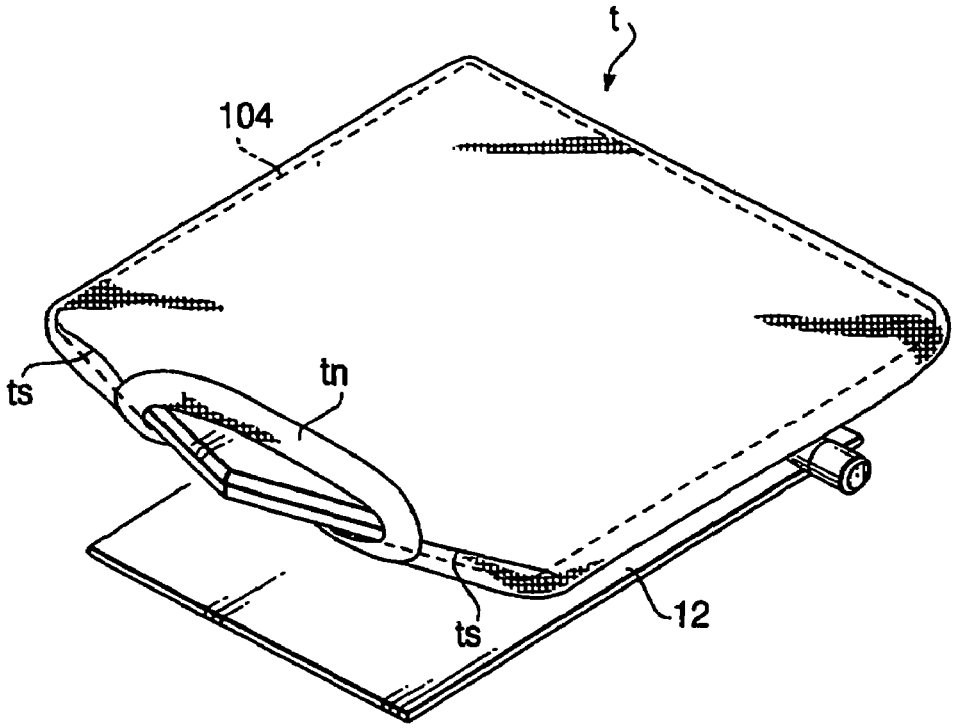
Figure 14:
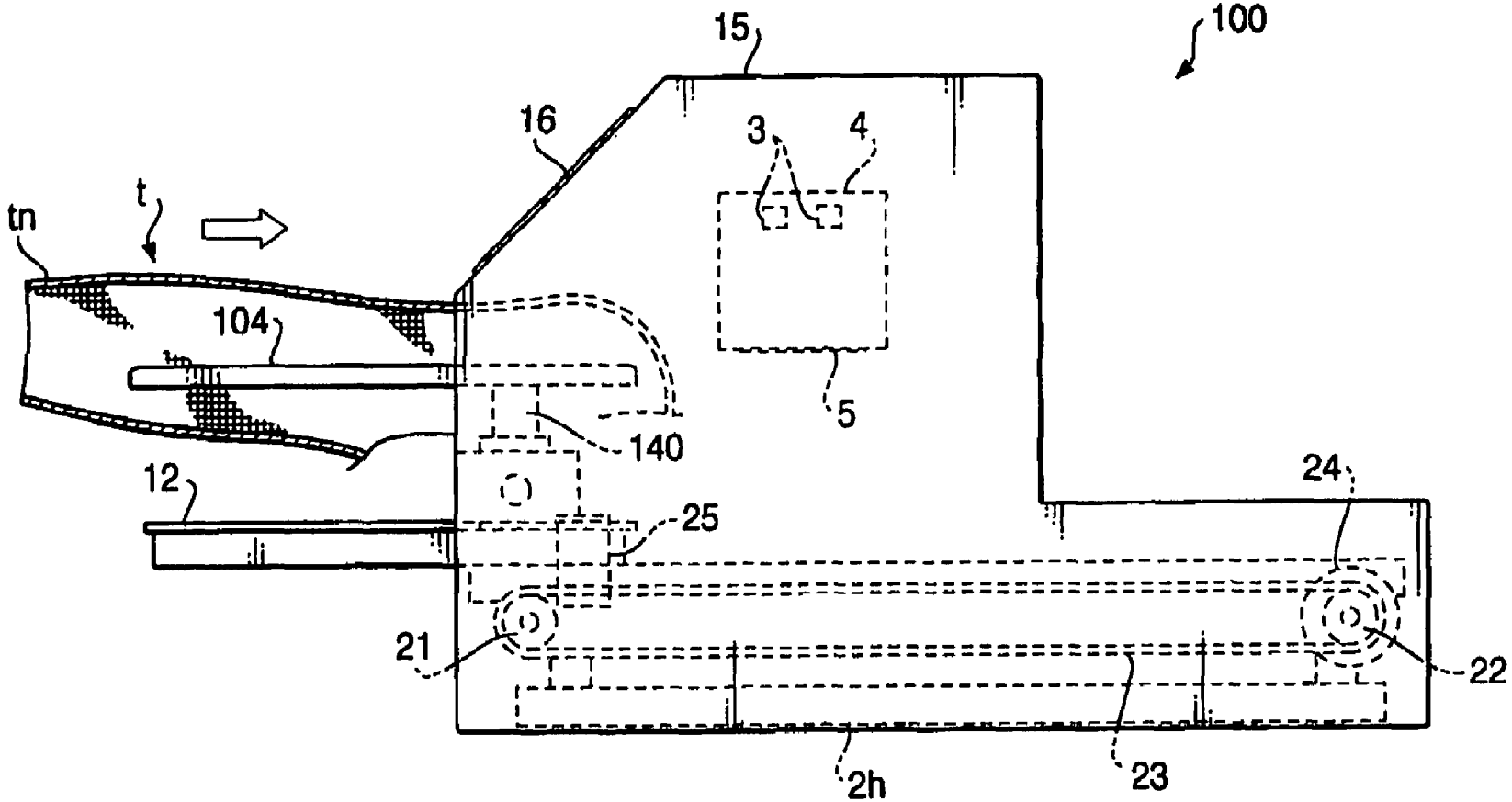
Figure 15:
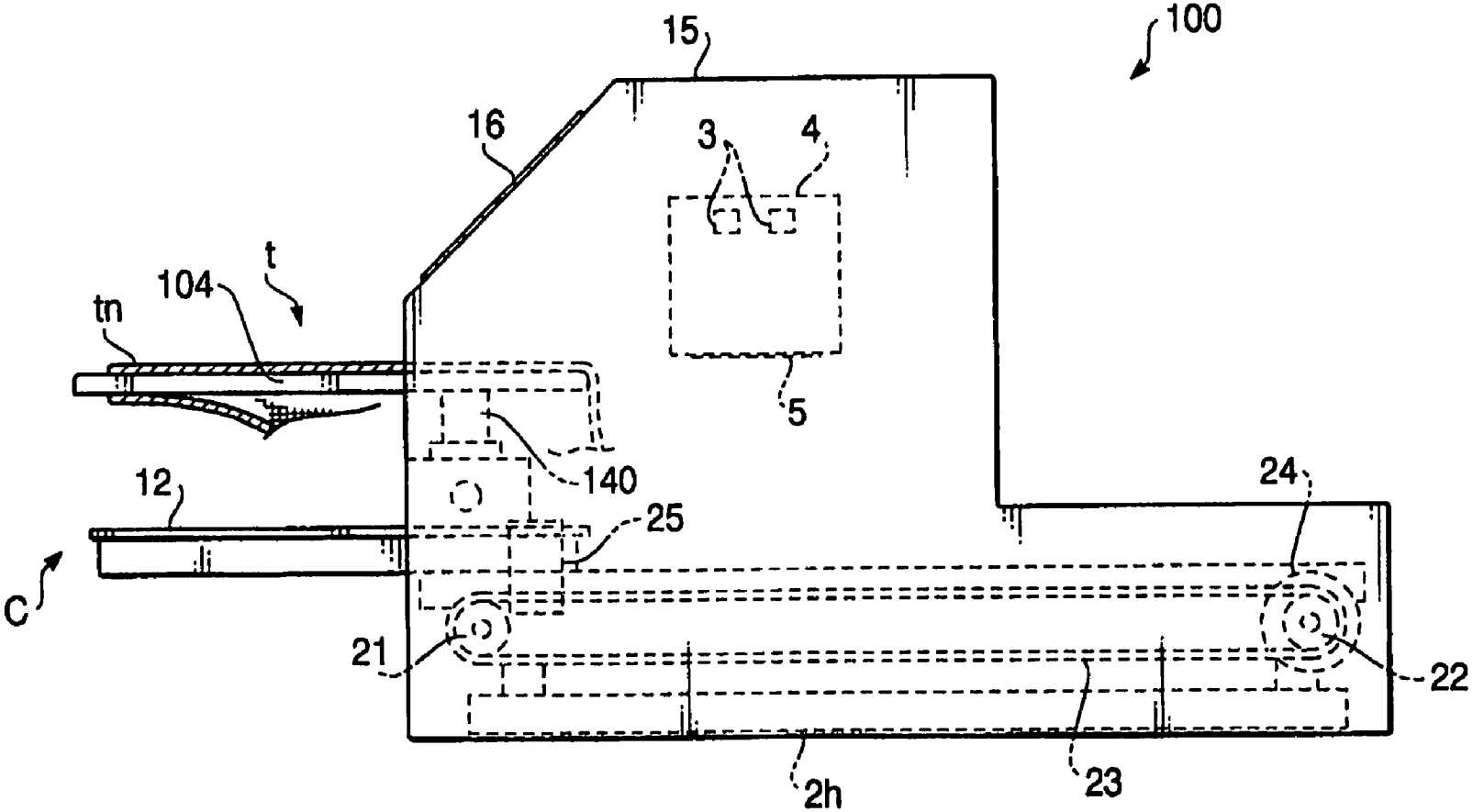
Figure 16:
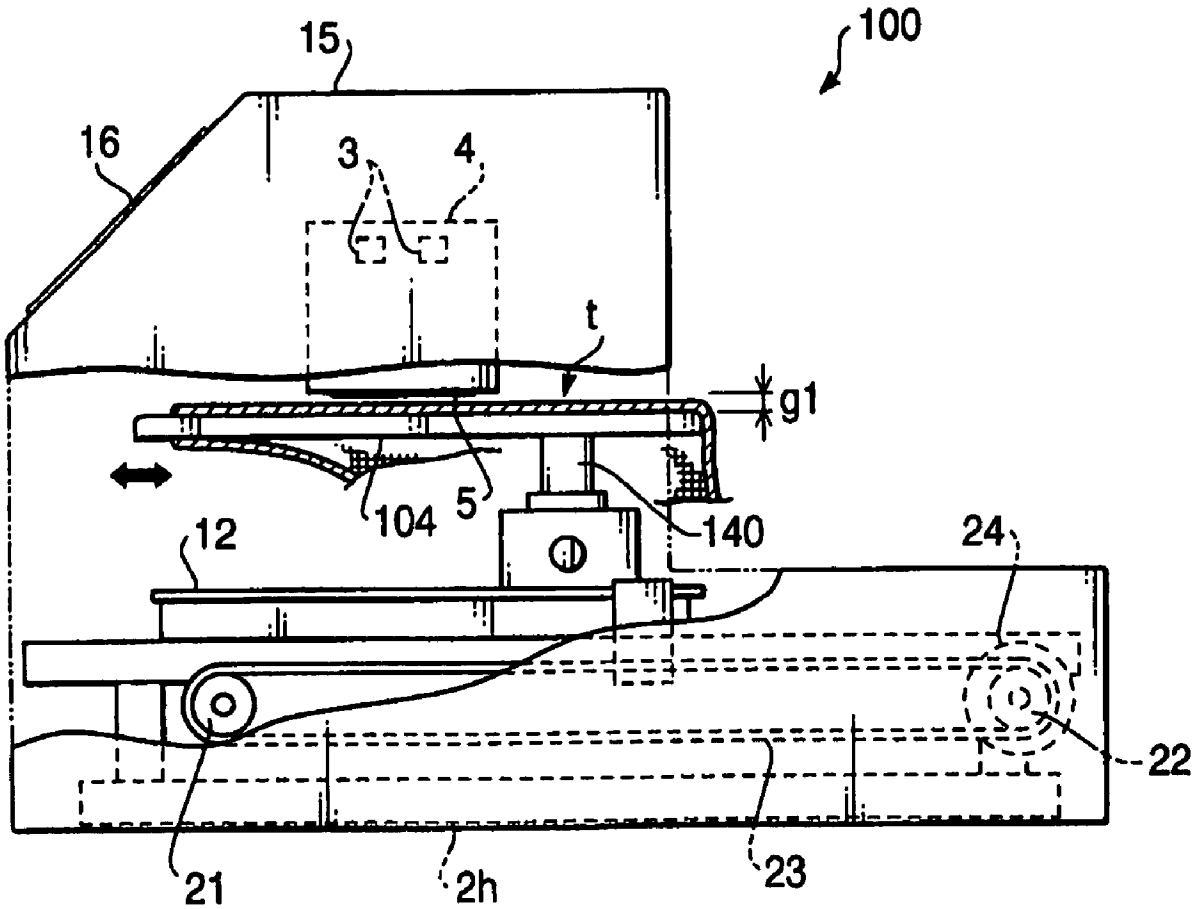
Figure 17:
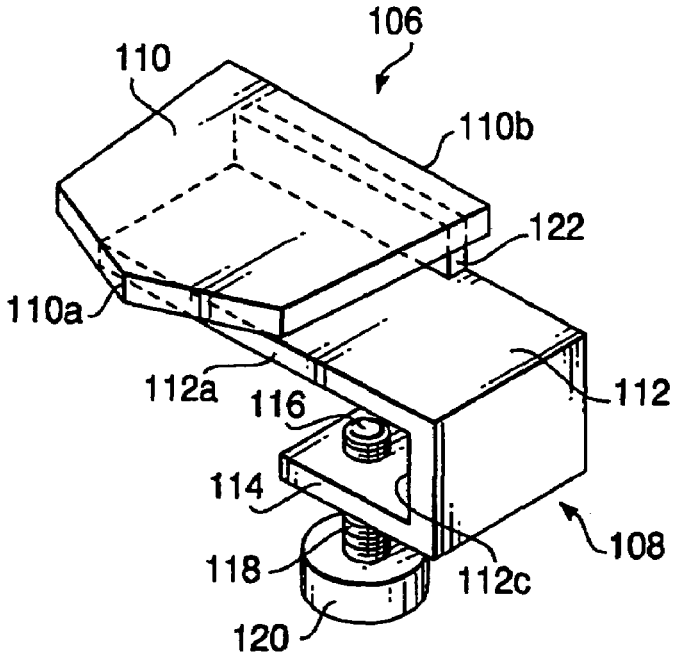
Figure 18:
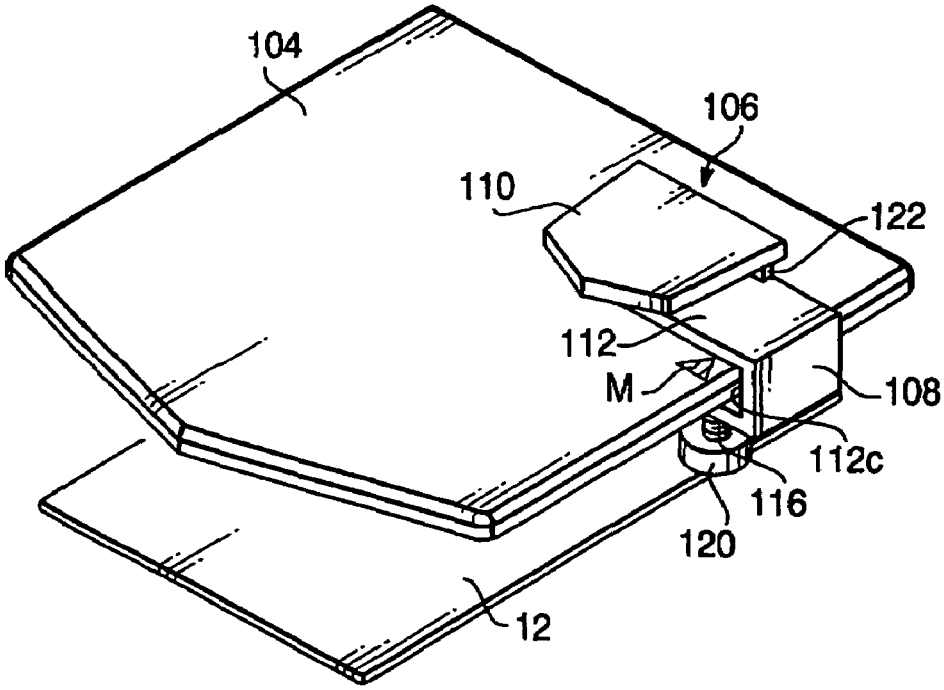
Figures 19A, 19B:
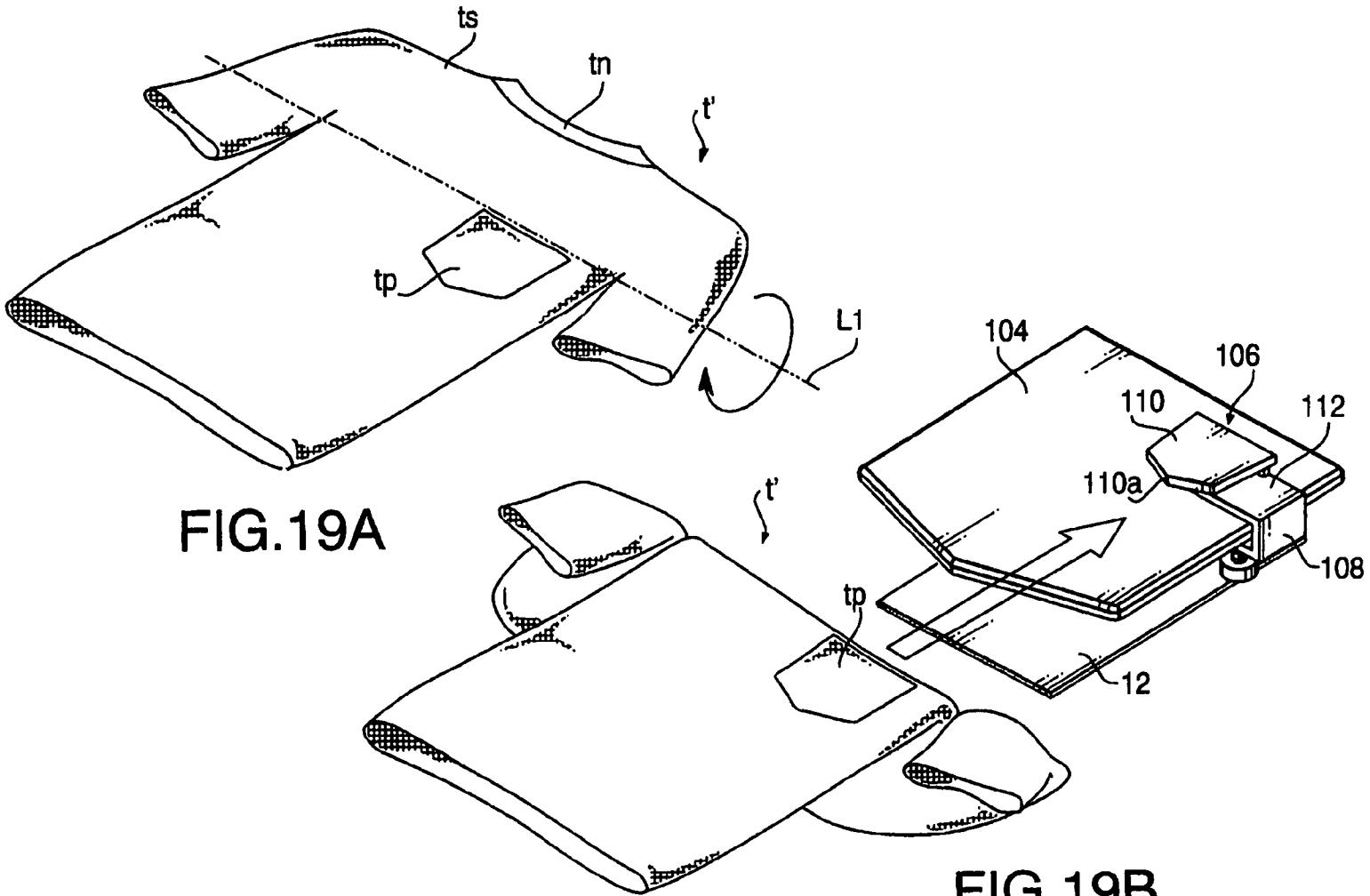
Figure 20:
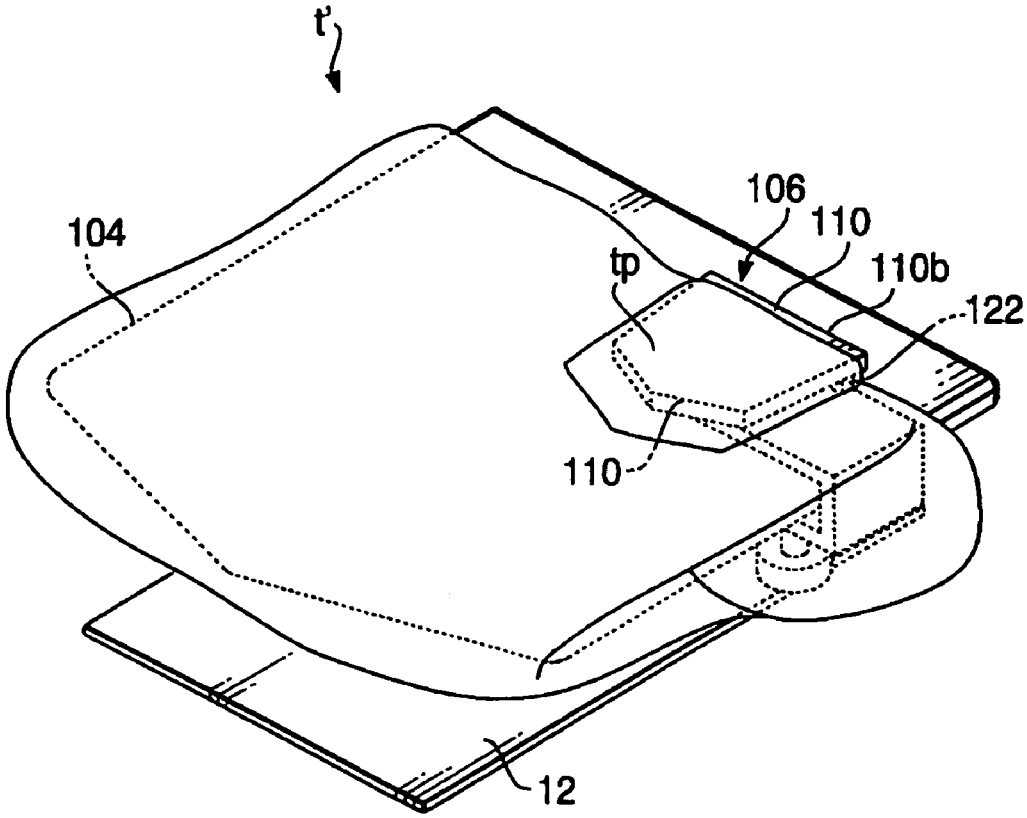
Figure 21:
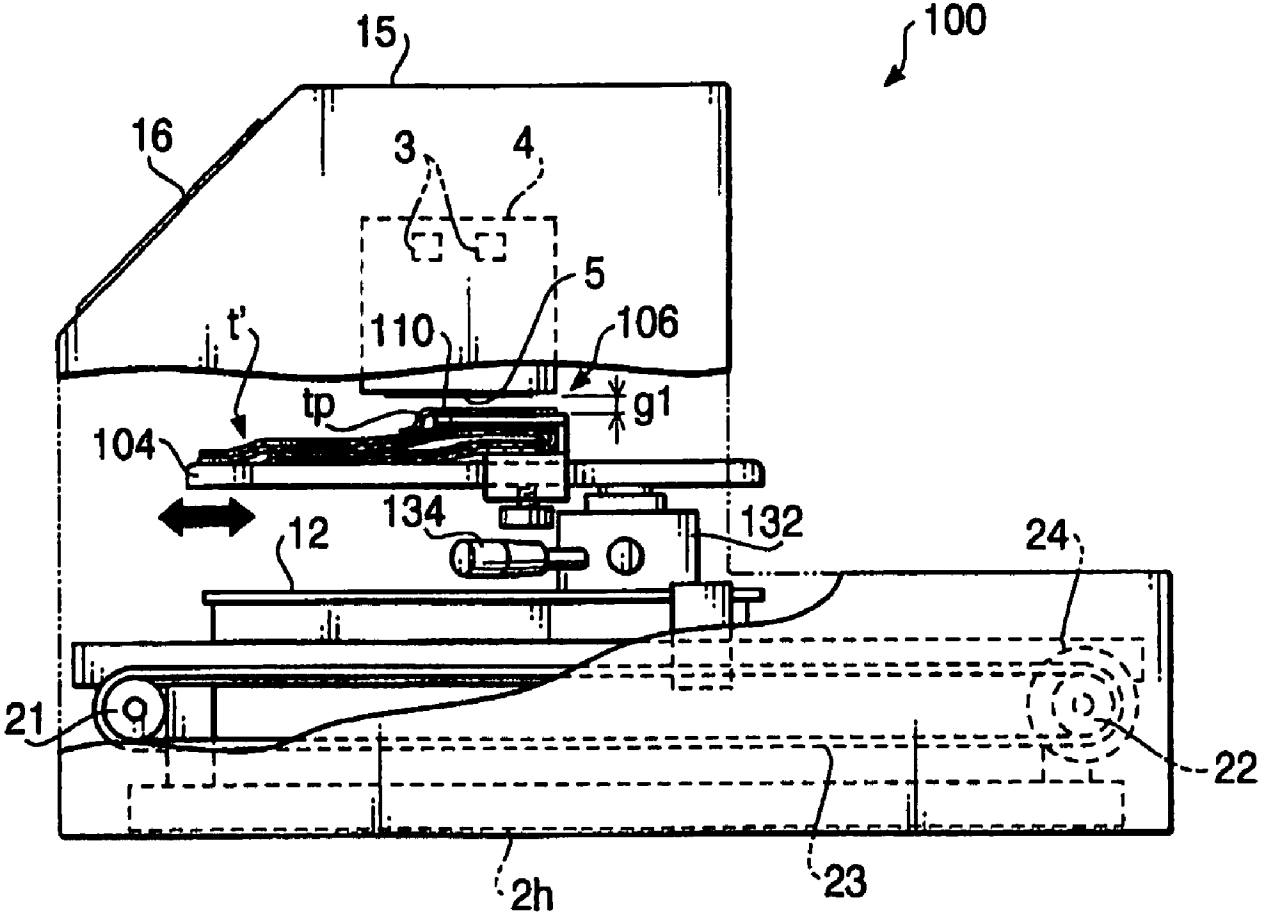
Figure 22A:
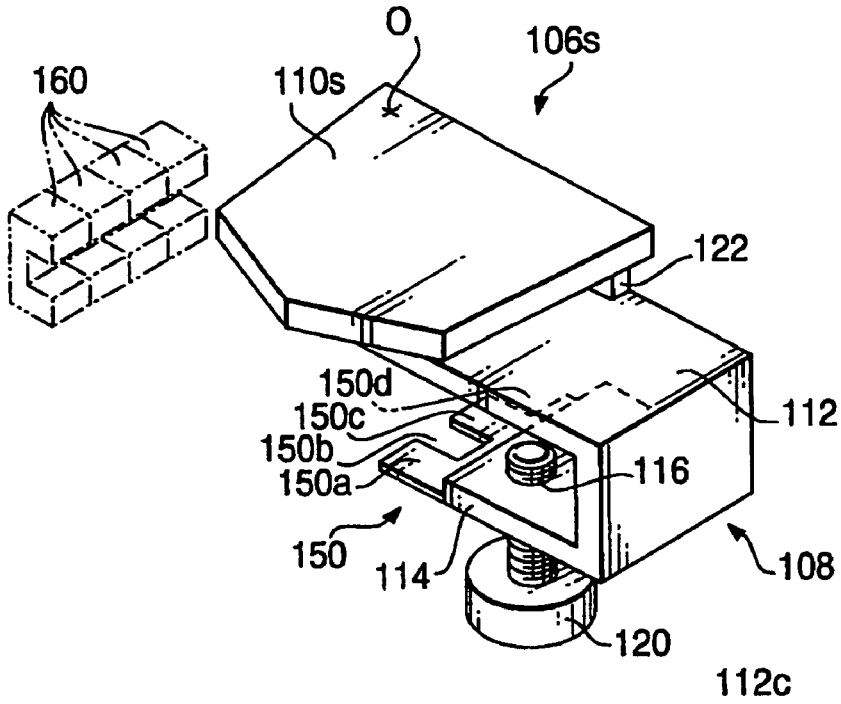
Figure 22B:
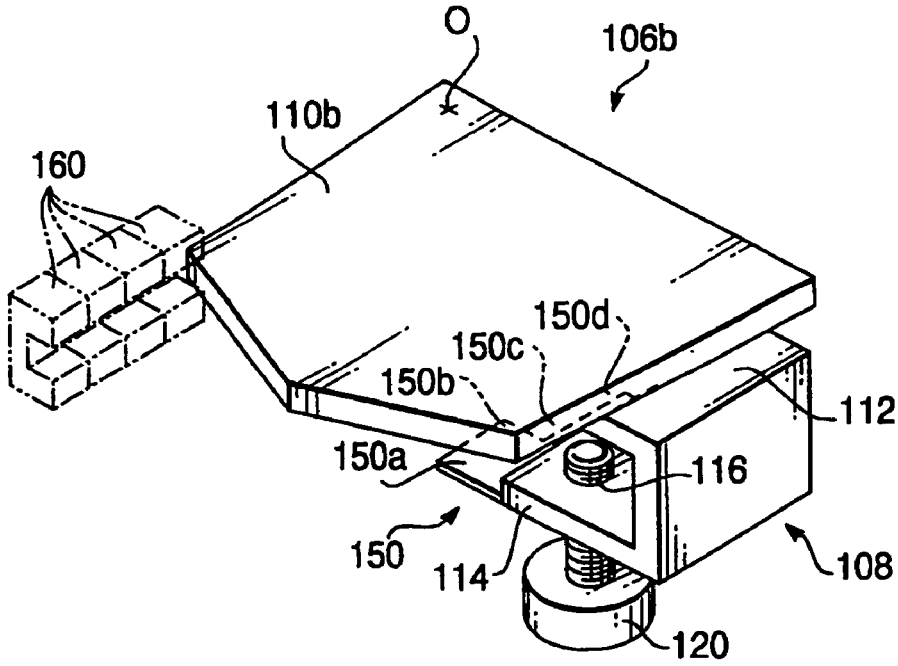
Figure 23:
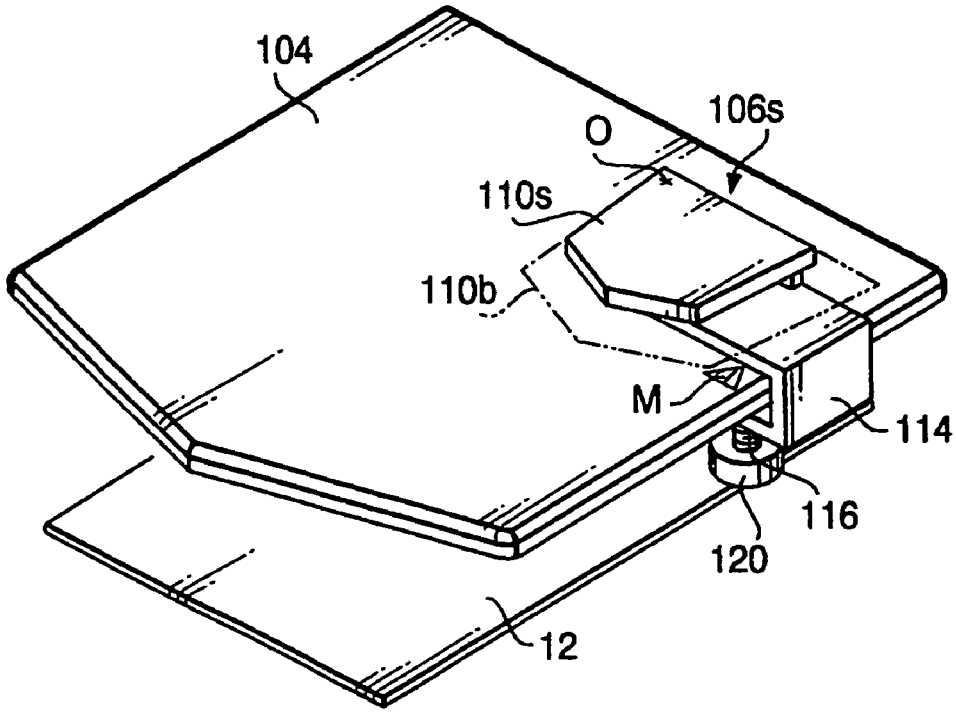
Figure 24:
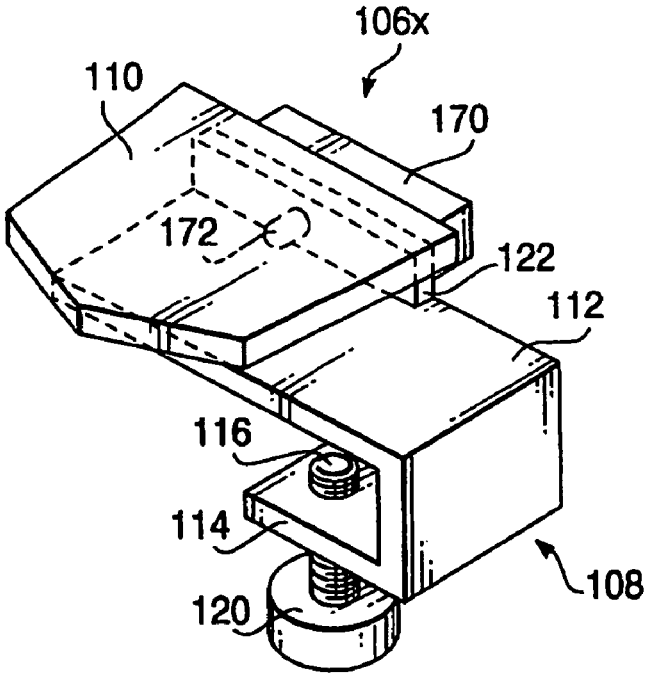
Figure 25:
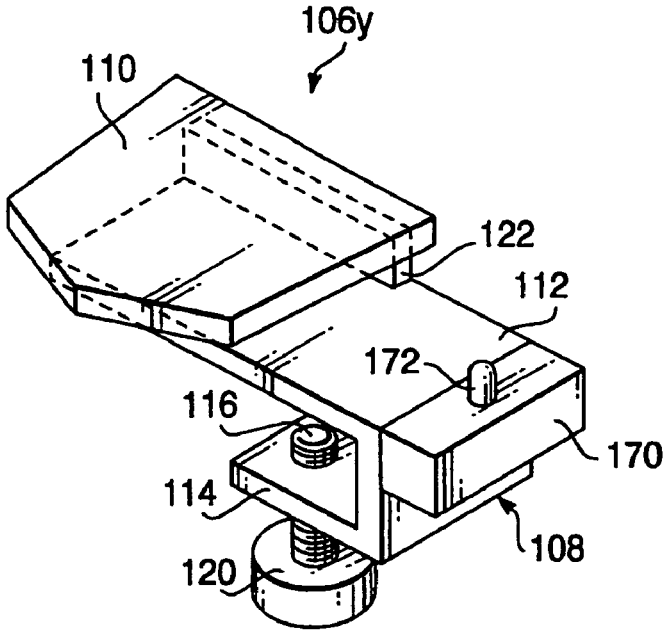
Figure 26:
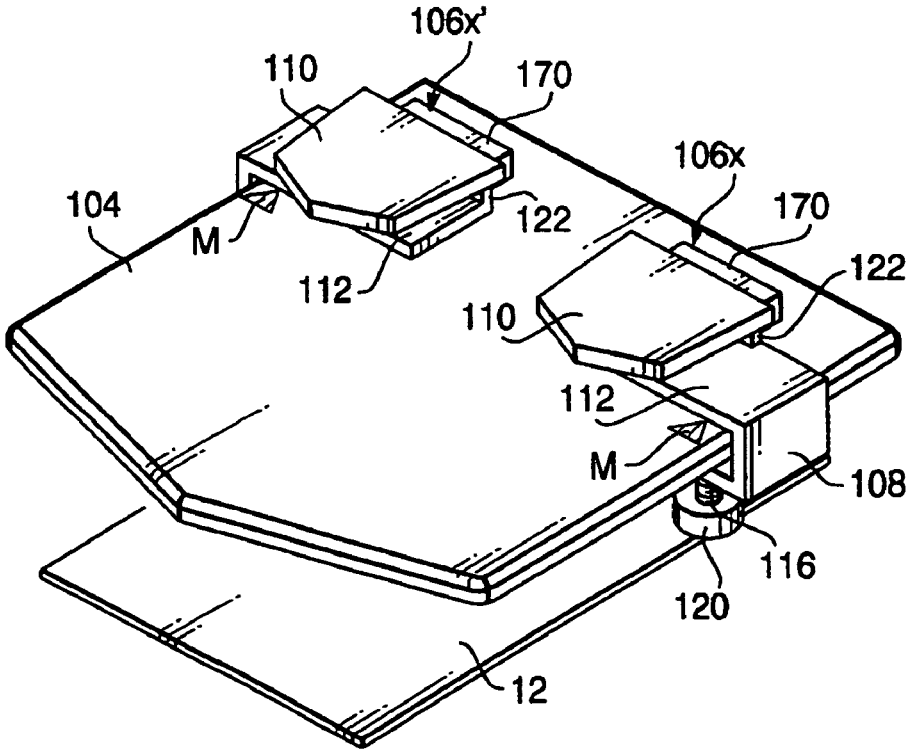
Figure 27:
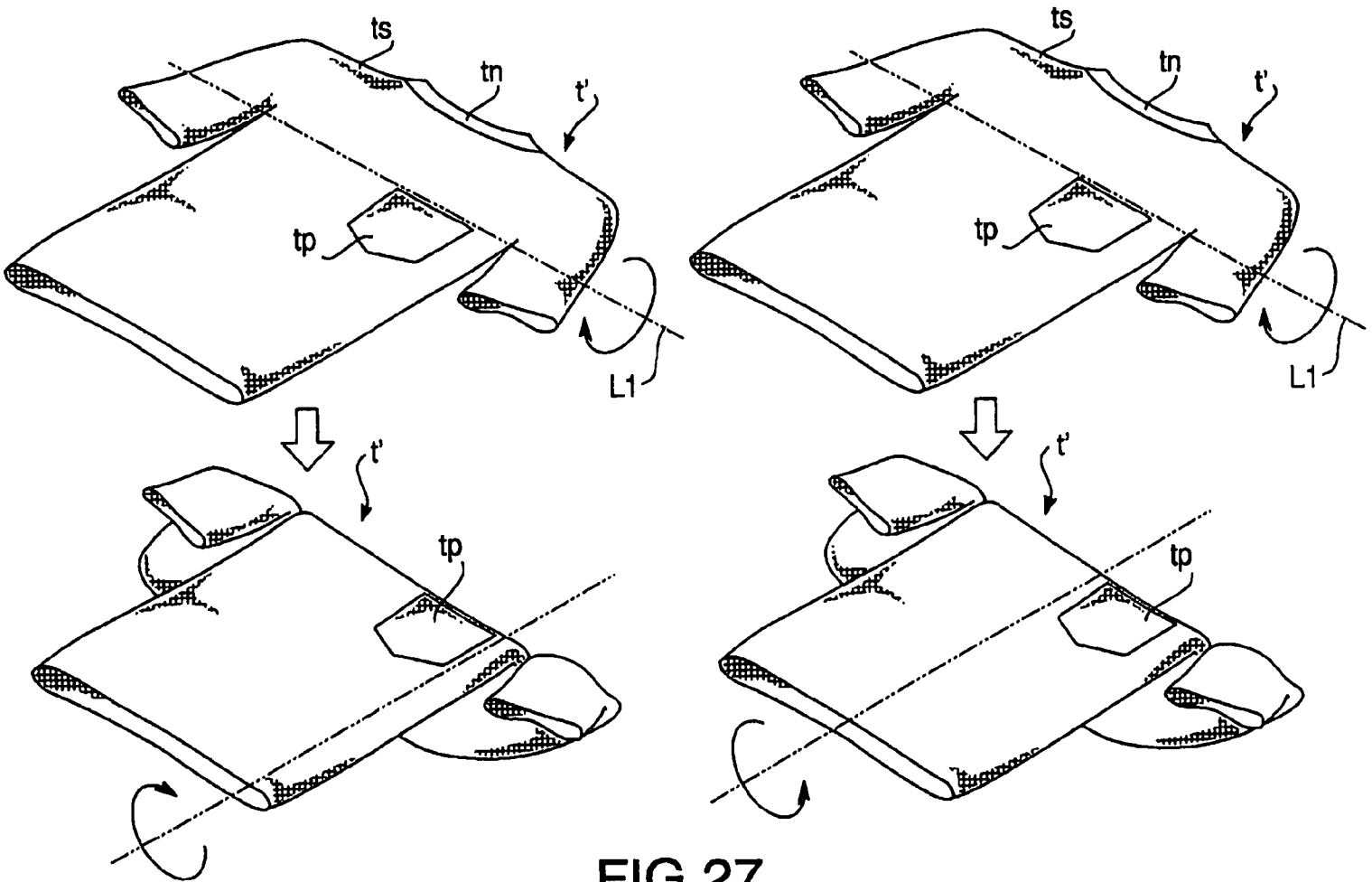
Figure 28:
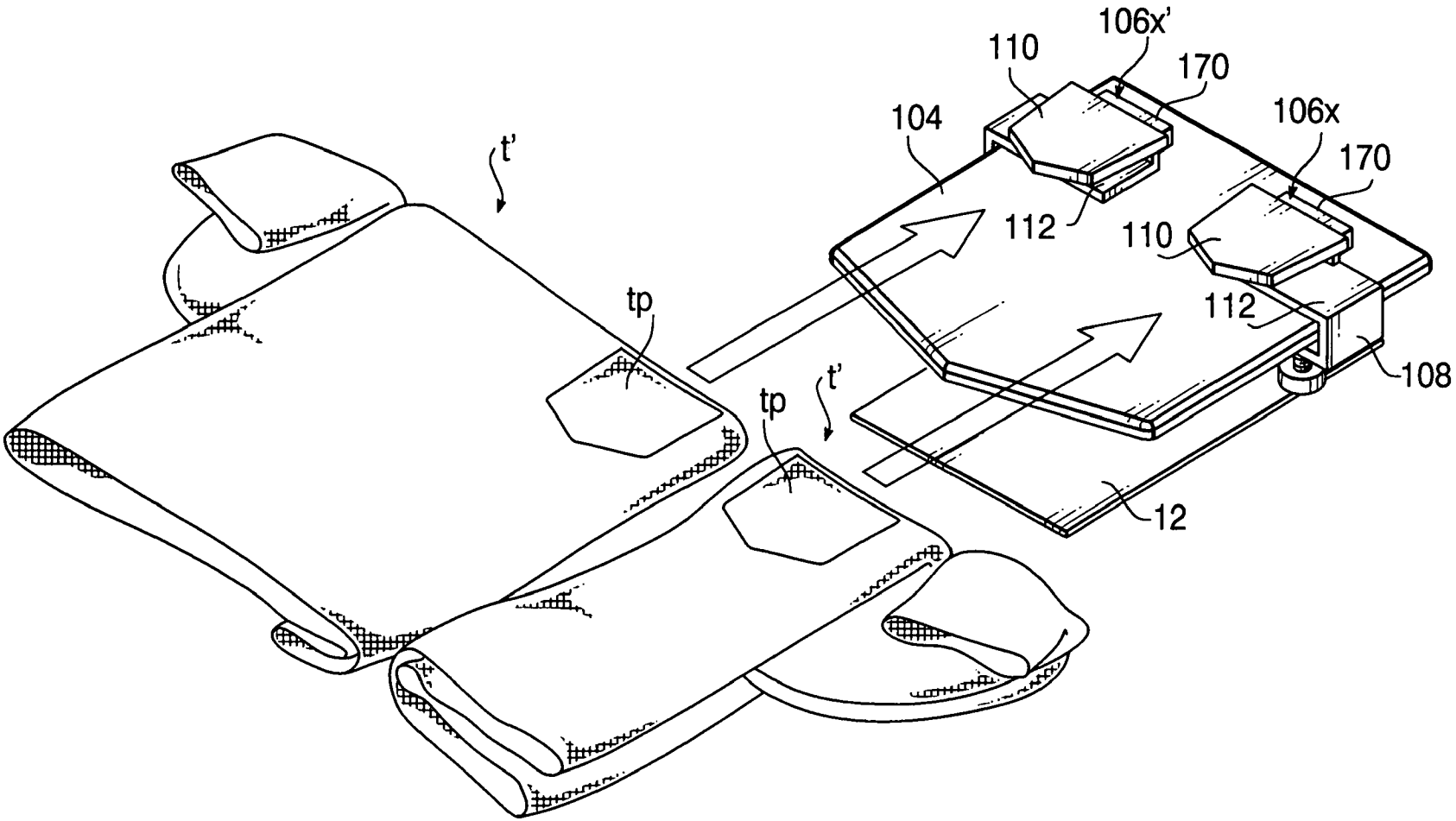
Figure 29:
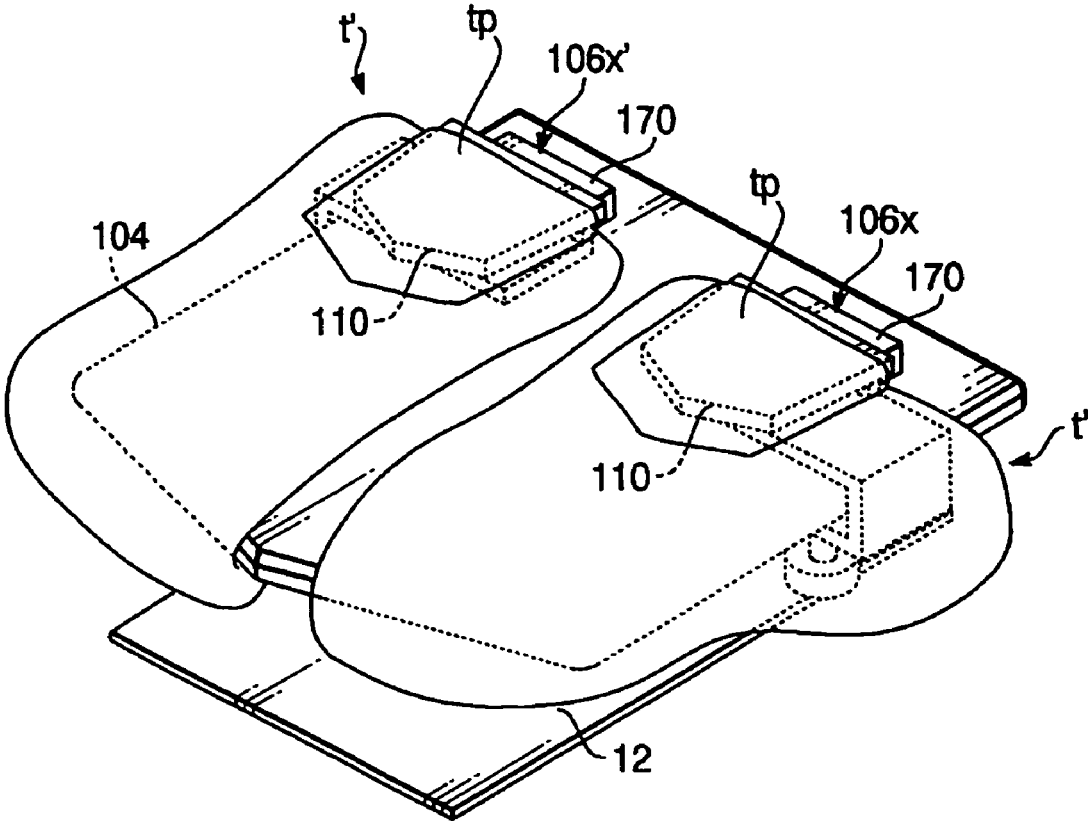
Figure 30:
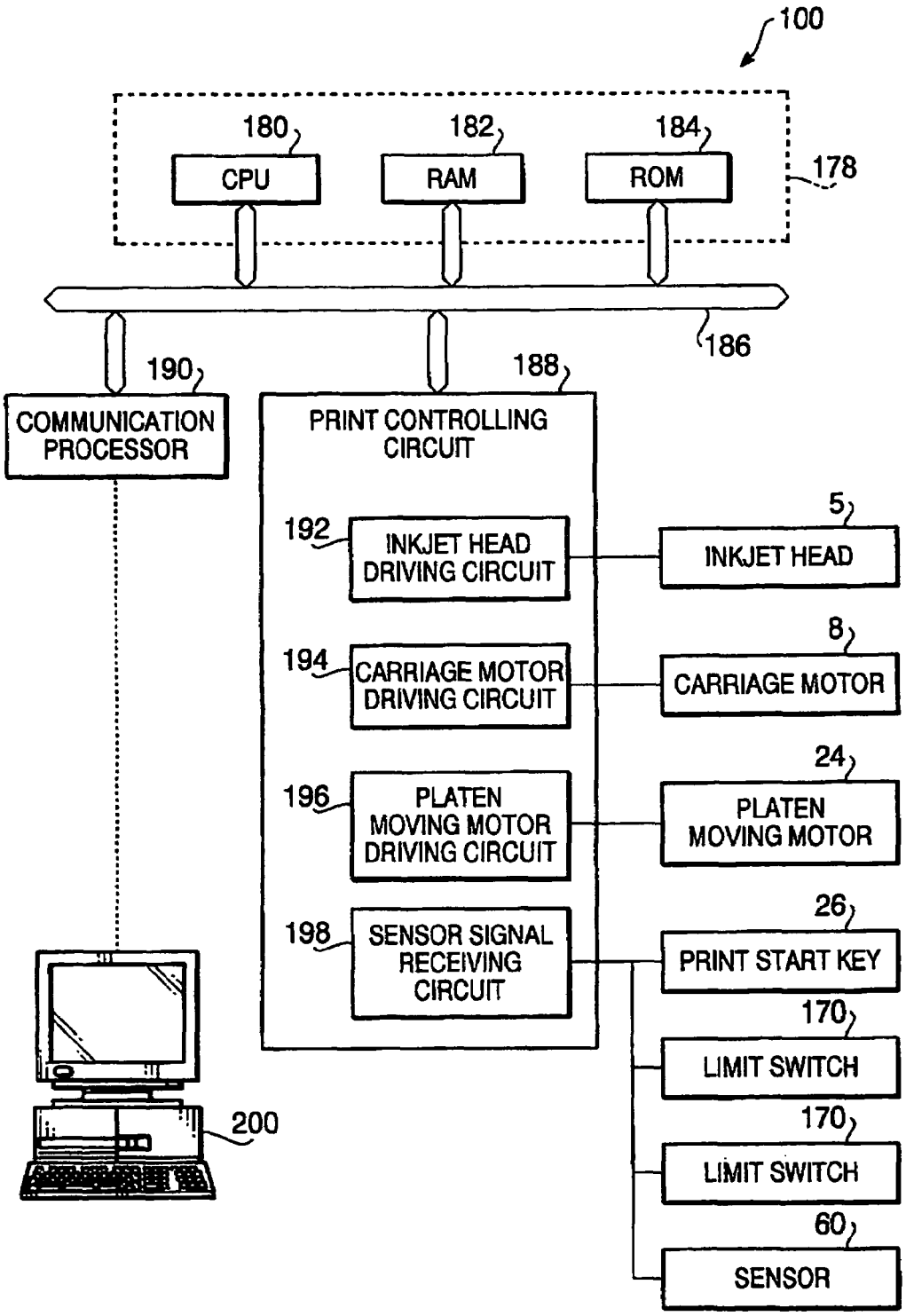
Figure 31:
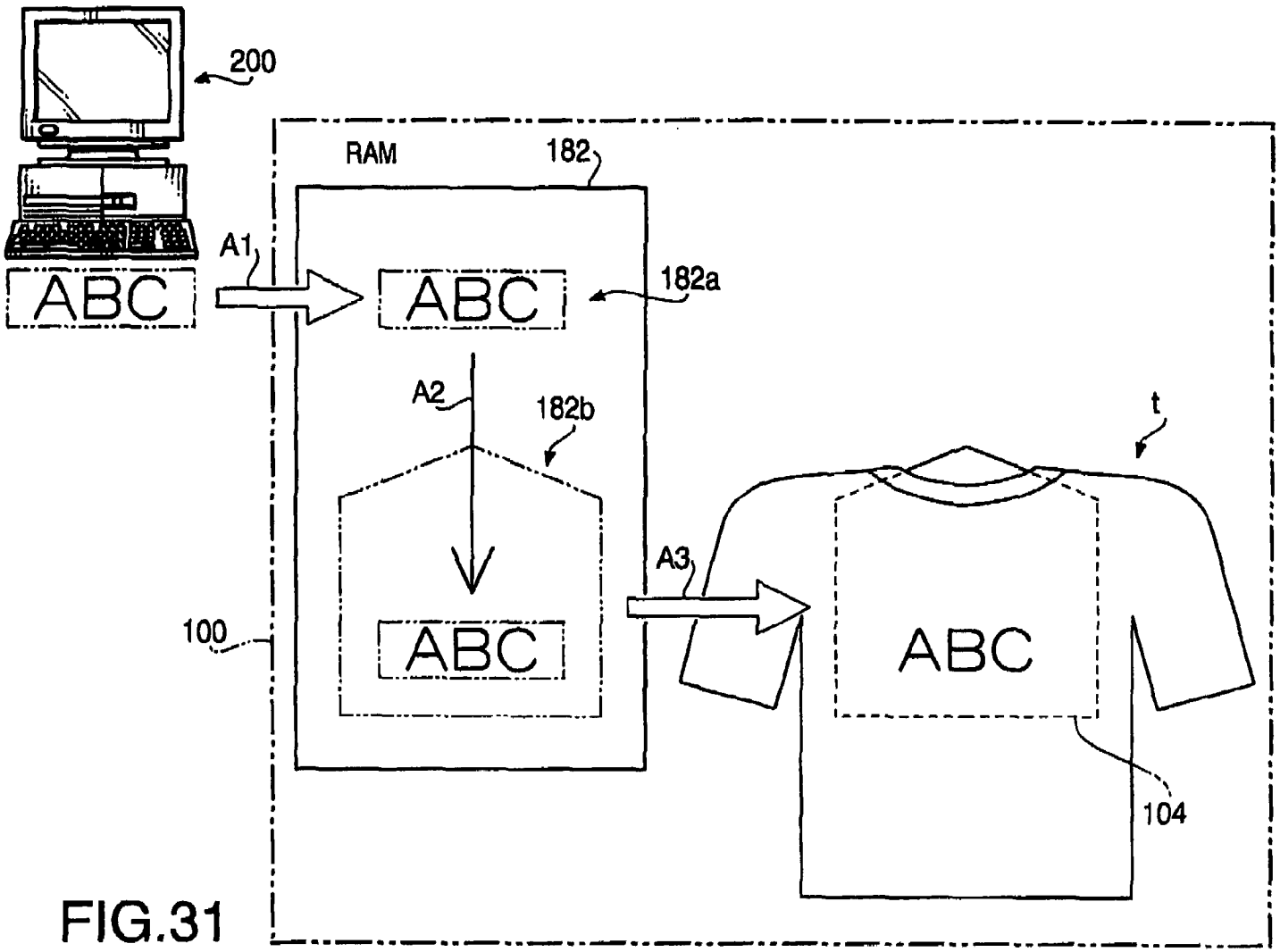
Figure 32:
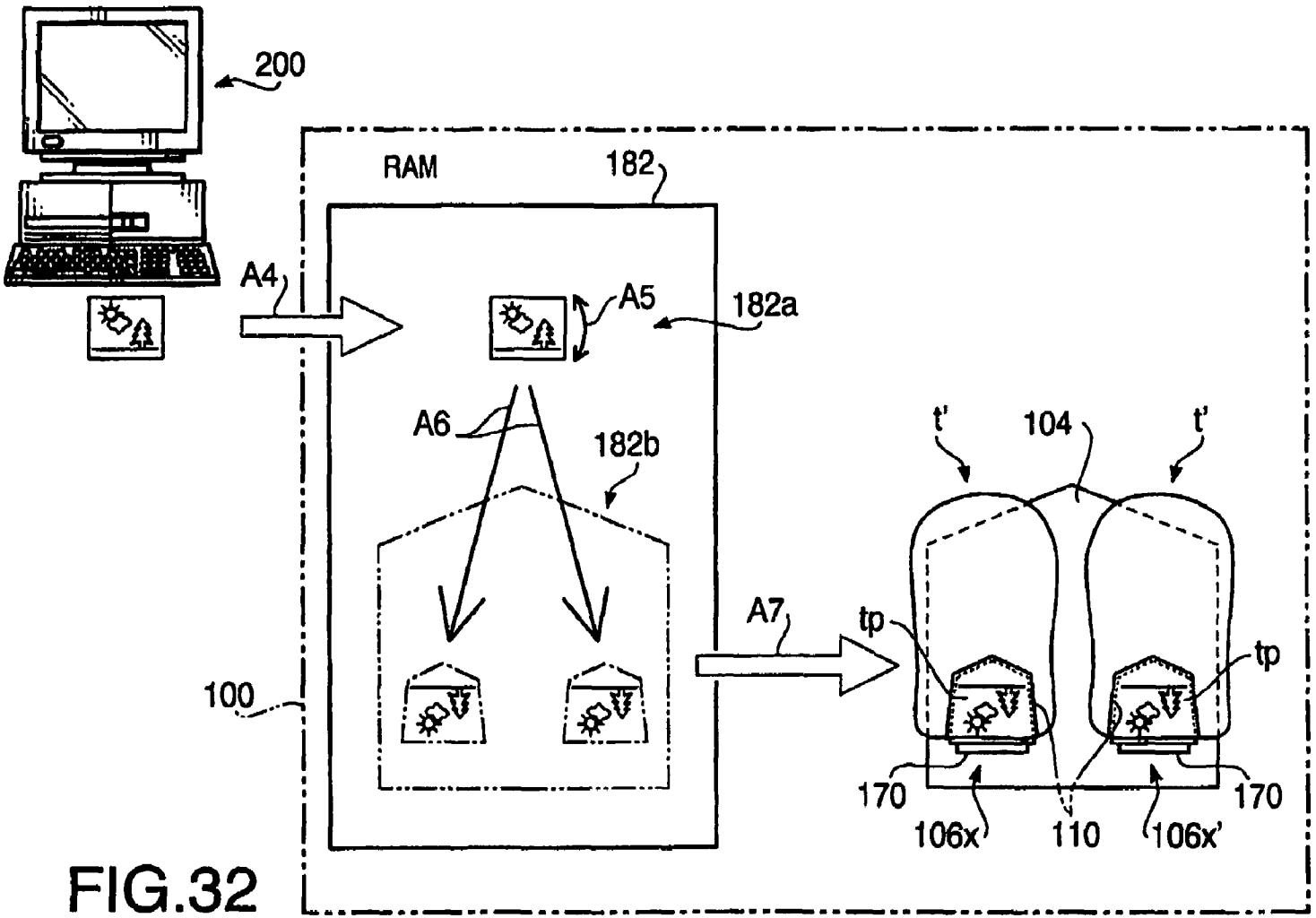
Figure 33:
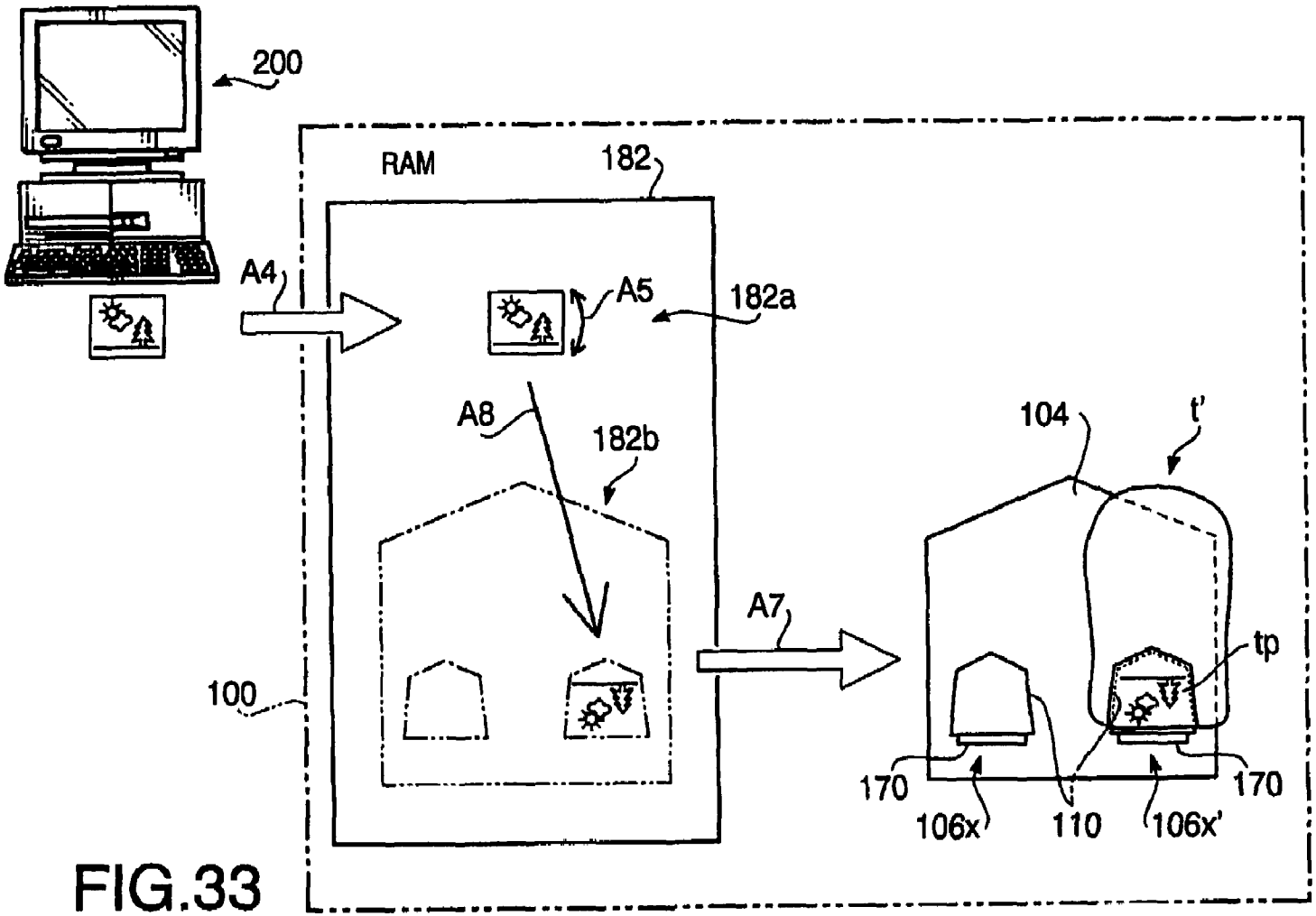
Figure 34:
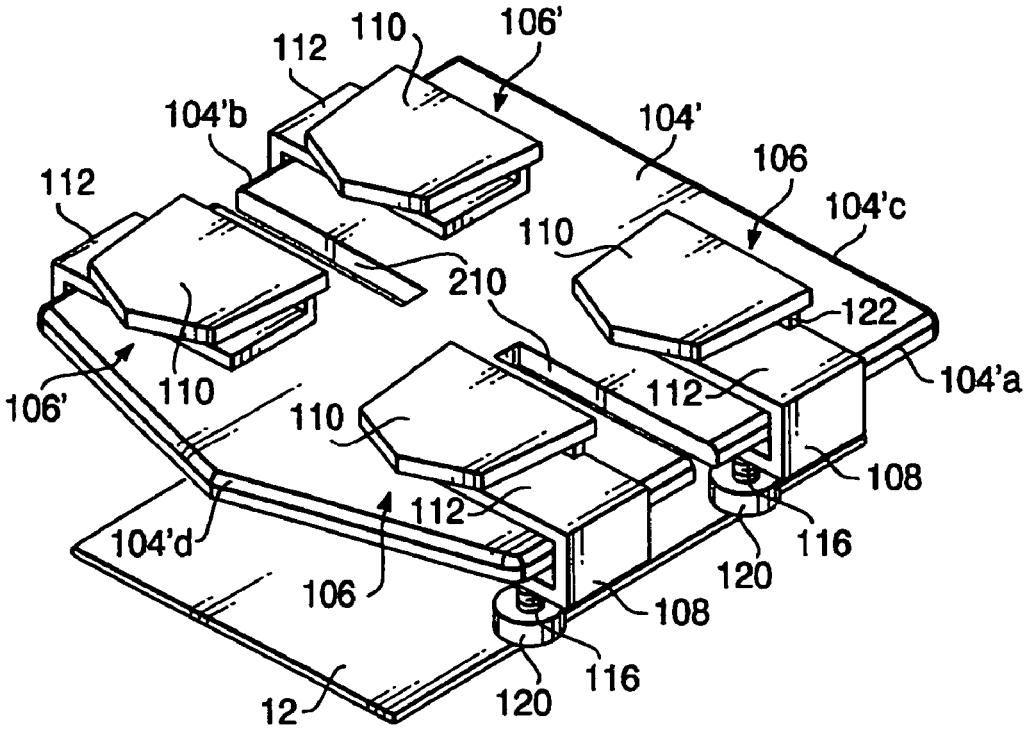
Figure 35:
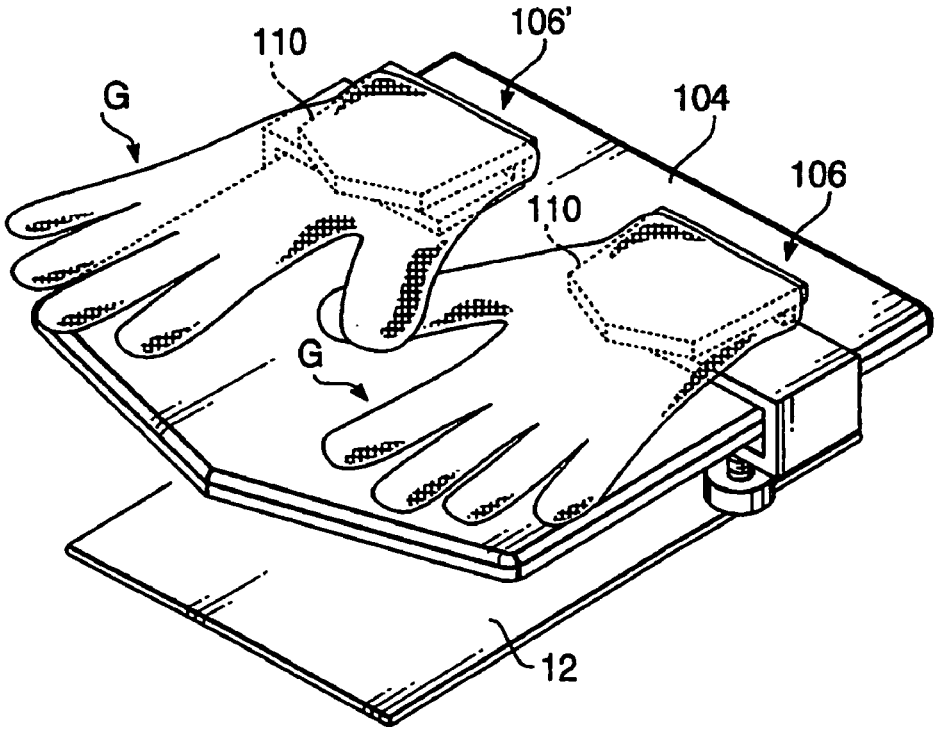
Figure 36:
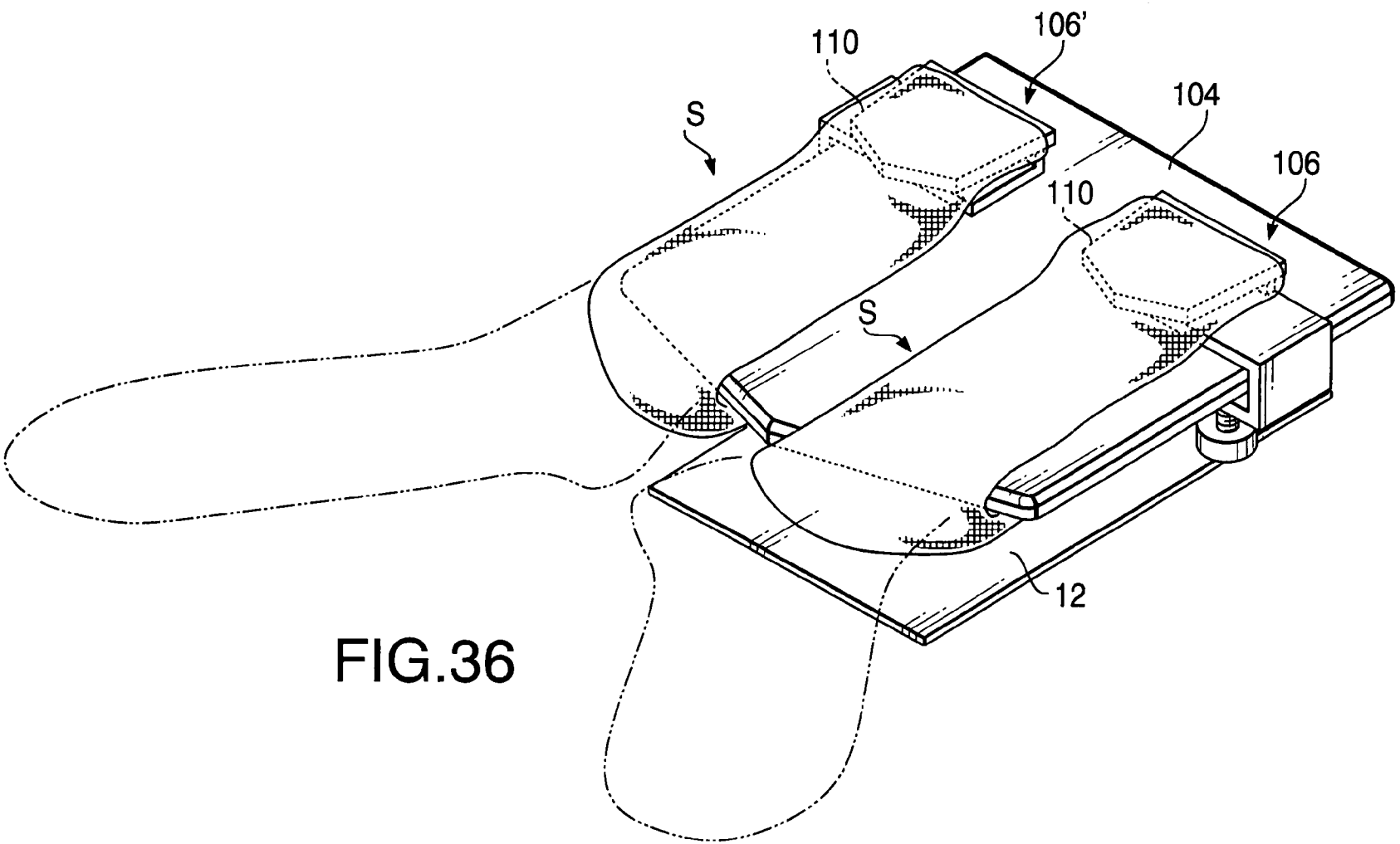
Figure 37:
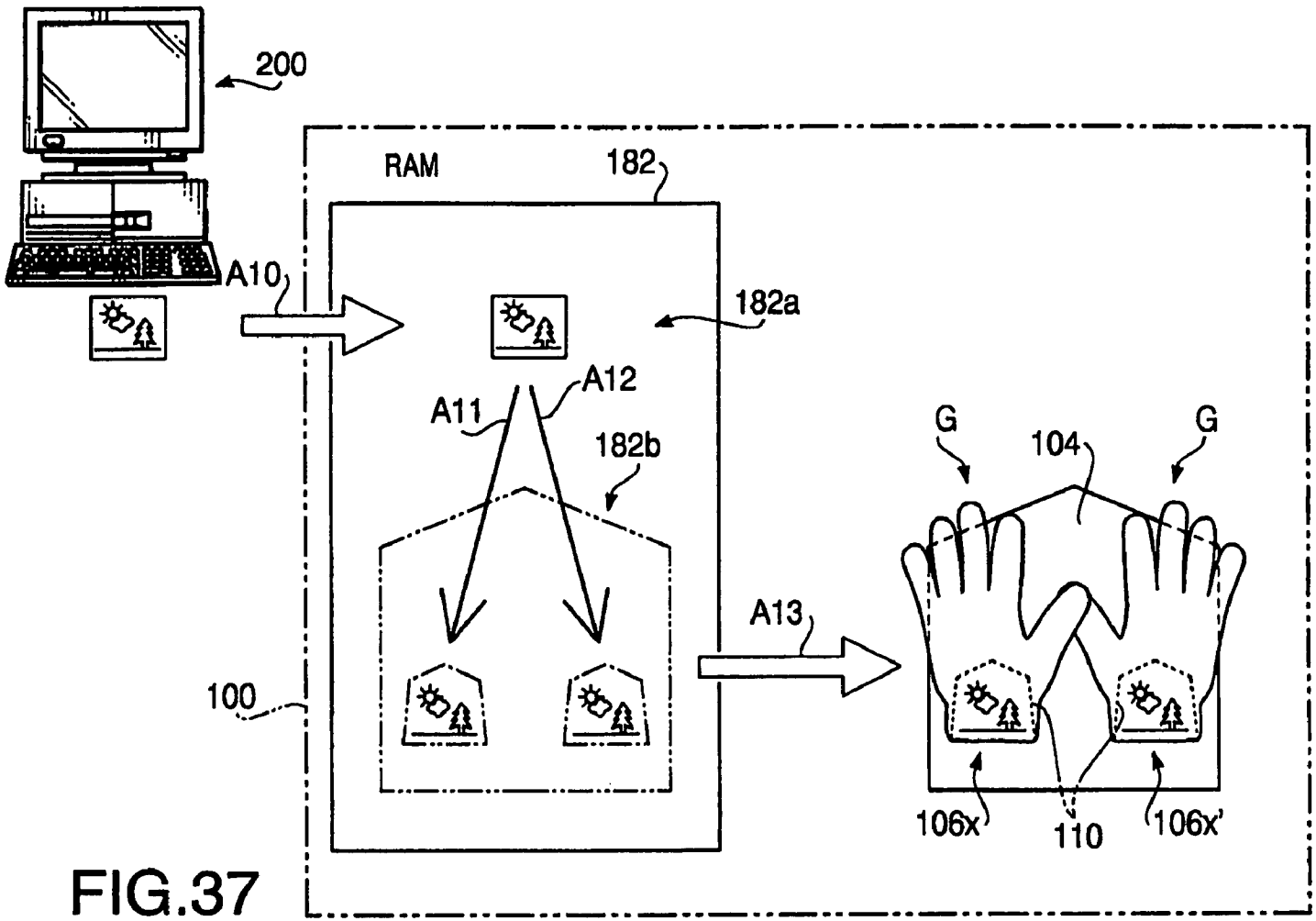
Figure 38:
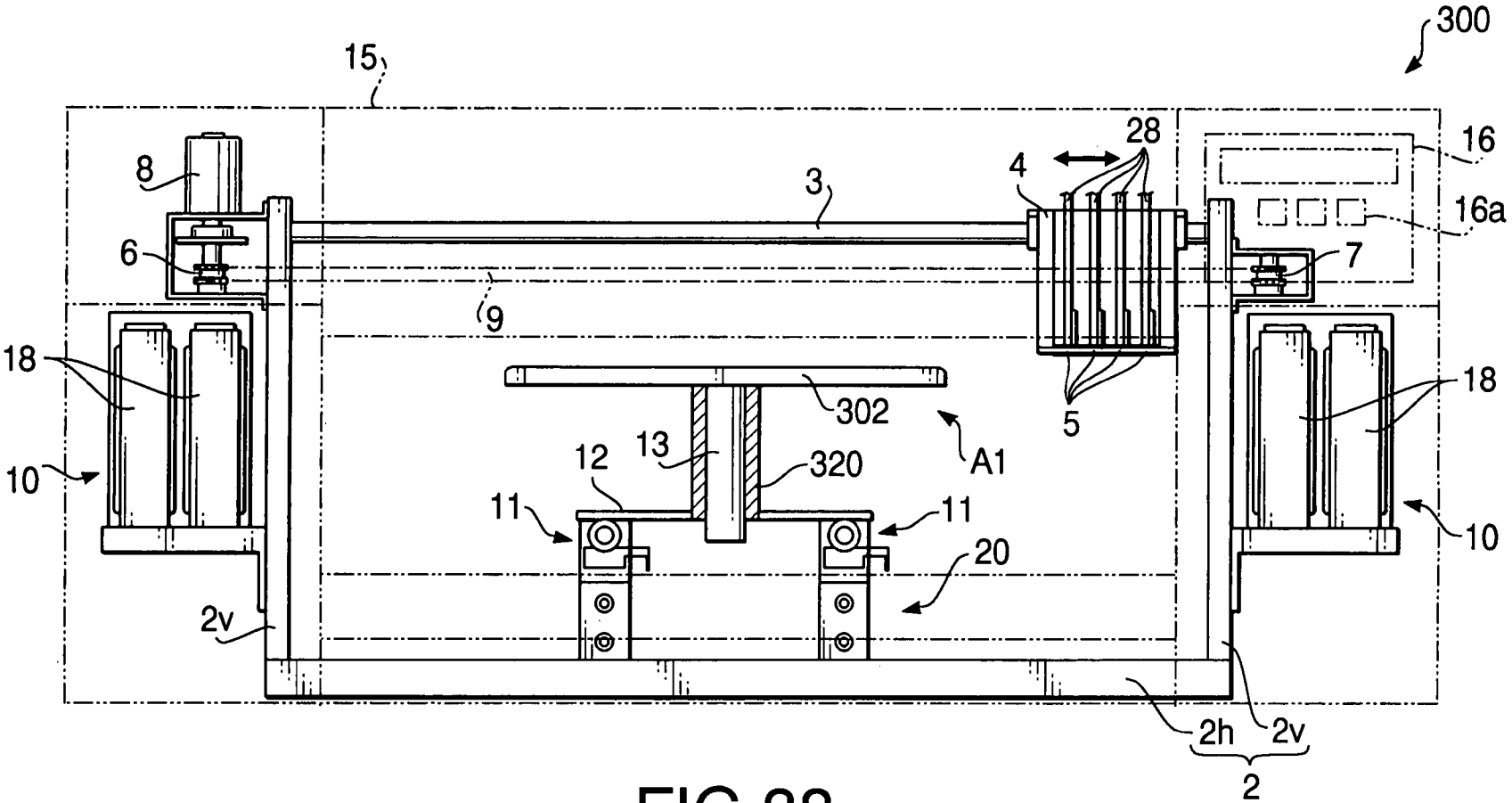
Figure 39A:
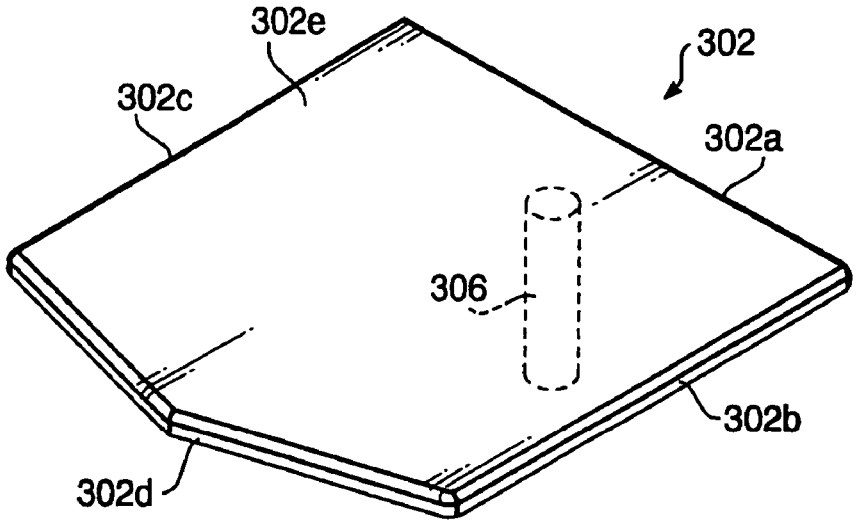
Figure 39B:
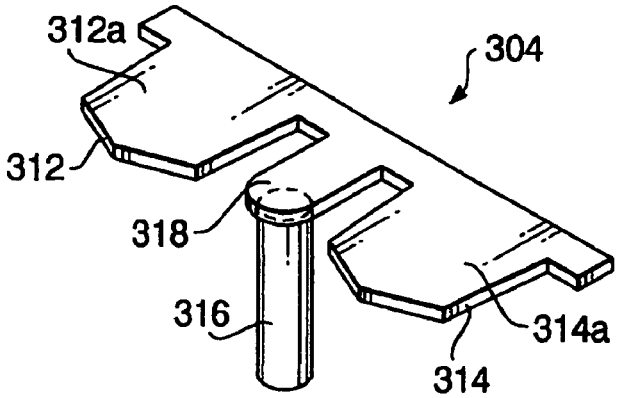
Figure 40:
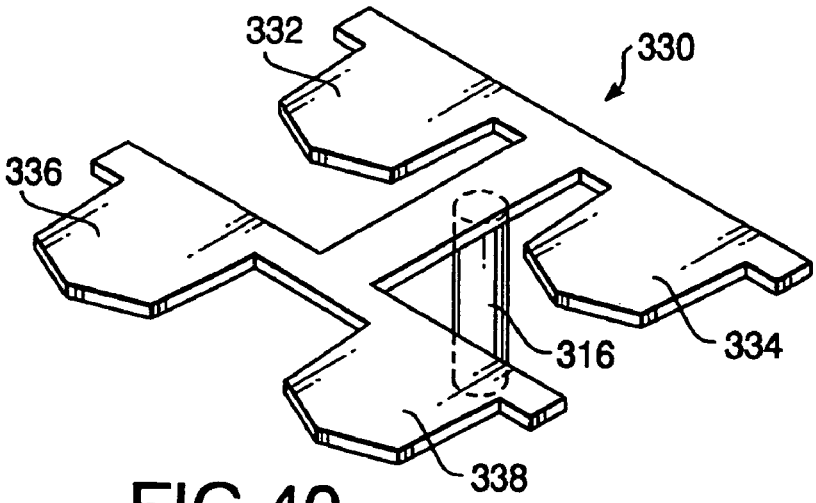

FIGS. 5 and 6 schematically illustrate setting of the T-shirt to the fabric printing apparatus of FIG. 1;

FIG. 7 schematically illustrates the fabric printing apparatus of FIG. 1 when printing is performed;

FIGS. 8A and 8B illustrate an advantageous structure of the platen according to the first embodiment of the invention;

FIG. 9 schematically illustrates a configuration of a fabric printing apparatus which is a variation of the fabric printing apparatus shown in FIG. 1;

FIG. 10 is a front view of a fabric printing apparatus according to a second embodiment of the invention;

FIG. 11 is a side view of the fabric printing apparatus shown in FIG. 10;

FIG. 12 is a perspective view of a part of the fabric printing apparatus including a main platen;

FIG. 13 shows a perspective view of the part of the fabric printing apparatus shown in FIG. 12 with a T-shirt set on the main platen;

FIGS. 14 and 15 schematically illustrate setting of the T-shirt to the fabric printing apparatus of FIG. 10;

FIG. 16 schematically shows the fabric printing apparatus of FIG. 10 printing images on a fabric set on the main platen;

FIG. 17 shows a perspective view of an additional platen of the fabric printing apparatus of FIG. 10;

FIG. 18 shows the additional platen mounted on the main platen;

FIGS. 19A and 19B and FIG. 20 illustrate a way of setting a pocket of a T-shirt on the additional plate;

FIG. 21 schematically shows the fabric printing apparatus of FIG. 10 printing on a pocket of the fabric set on the additional platen;

FIGS. 22A and 22B show two different additional platens, which have substantially the same configurations except the size of work plates;

FIG. 23 shows the additional platen mounted on the main platen at a position indicated by a mark of the main platen;

FIGS. 24 and 25 show perspective views of modifications of the additional platen shown in FIG. 17;

FIG. 26 shows a pair of symmetrical additional platens mounted on the main platen;

FIGS. 27, 28 and 29 schematically illustrate a manner of setting two T-shirts on the pair of additional platens;

FIG. 30 is a block diagram illustrating an electrical configuration of the fabric printing apparatus shown in FIG. 10;

FIG. 31 schematically illustrates a flow of image data when an image is to be printed by the fabric printing apparatus shown in FIG. 10 on a chest portion or back portion of a T-shirt;

FIGS. 32 and 33 schematically illustrate flows of image data when images are to be printed by the fabric printing apparatus shown in FIG. 10 on a fabric set on the pair of additional platens;

FIG. 34 shows a further modification of the main platen of the fabric printing apparatus shown in FIG. 10, which is provided with four additional platens mounted on the main platen;

FIGS. 35 and 36 schematically show a pair of the additional platens attached to the main platen with a pair of gloves and a pair of socks set thereon, respectively;

FIG. 37 schematically illustrates a flow of image data when a pair of symmetrical images are to be printed by the fabric printing apparatus shown in FIG. 1 on a pair of pieces of fabric;

FIG. 38 schematically shows a configuration of a modification of the fabric printing apparatus shown in FIG. 10;

FIGS. 39A and 39B shows perspective views of a first platen and a second platen, respectively, which can be detachably attached to the fabric printing apparatus shown in FIG. 38; and FIG. 40 shows a variation of the second platen shown in FIG. 39B.

DETAILED DESCRIPTION OF THE EMBODIMENTS

Hereinafter, embodiments of the present invention will be described with reference to the accompanying drawings.

First Embodiment

Figure 2:
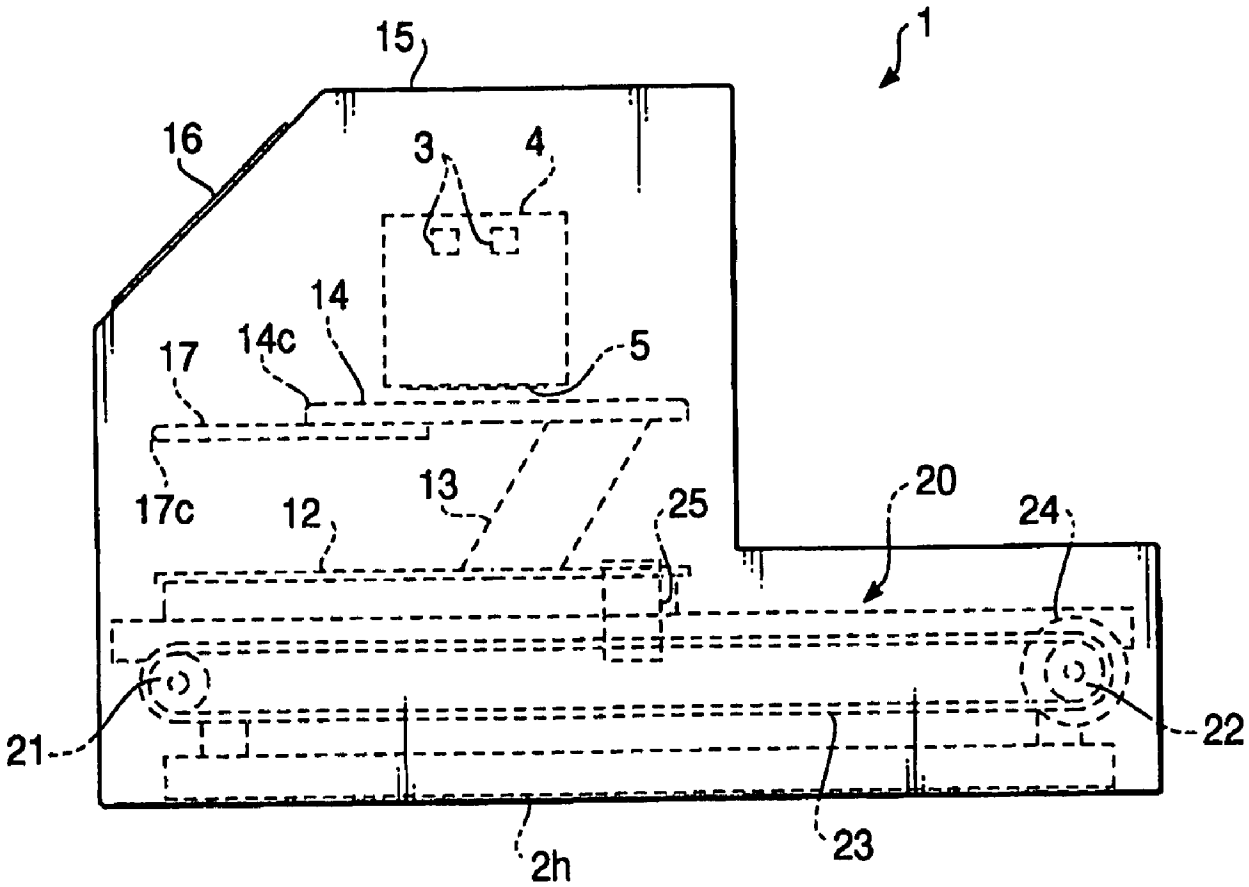
FIG. 2 is a side view of the fabric printing apparatus shown in FIG. 1.

FIGS. 1 and 2 are a front view and a side view, respectively, of a fabric printing apparatus 1 according to a first embodiment of the invention. As shown in FIG. 1, the fabric printing apparatus 1 includes a frame 2 provided on a casing (which is schematically illustrated by chain double-dashed lines). The frame 2 includes a horizontal portion 2*h* horizontally disposed on the bottom of the fabric printing apparatus 1 and vertical portions 2*v* extending perpendicularly to and upward from both sides of the horizontal portion 2*h*.

A slide rail 3 is horizontally supported by the vertical portions 2*v* to extend between the upper ends thereof. A carriage 4 is mounted on the slide rail 3 slidably in a longitudinal direction of the slide rail 3, or a main scanning direction of the fabric printing apparatus 1. Four piezoelectric inkjet heads 5 are mounted on an undersurface of the carriage 4. Each inkjet head 5 corresponds to an ink of different color. Thus, these inkjet heads 5 can print an image in four colors.

The vertical portions 2*v* support a pair of pulleys (6, 7) at the upper portions thereof. One of the pulleys 6, is coupled to a spindle of a carriage motor 8 supported by the same vertical portion 2*v*. An endless belt 9 is wound around the pulleys 6 and 7. The carriage 4 is secured to a predetermined position of the endless belt 9.

In the fabric printing apparatus 1 arranged as above, the carriage 4 reciprocates linearly along the slide rail 3 as the carriage motor 8 rotates the pulley 6 in normal and reverse directions. As a result, the inkjet heads 5 move back and forth in the main scanning direction (i.e., right-and-left direction in FIG. 1).

Each vertical portion 2*v* is provided with a mounting portion 10, on which ink tanks (stationary ink tanks) 18 are detachably mounted. In this example, each mounting portion 10 is arranged to hold two ink tanks 18, each containing different color ink. Each ink tank 18 includes an ink bag (not shown). The ink bags of the ink tanks 18 are connected, through flexible tubes 28, to respective ones of the inkjet heads 5. Thus, ink can be supplied from the ink tanks 18 to the inkjet heads.

As shown in FIG. 1, a slide mechanism 11 is provided on the horizontal portion 2*h* of the frame 2. The slide mechanism 11 supports a sliding base 12. A supporting column 13 is fixed on the upper surface of the sliding base 12. The supporting column 13 supports a platen 14 on the top thereof.

A horizontal flat working area is defined on the upper surface of the platen 14. Clothing can be set on the platen 14 with a side on which an image is to be printed being spread over the working area without any wrinkle. The fabric printing apparatus 1 according to the present invention prints images on a fabric placed on the platen 14.

A guide plate (positioning member) 17 is attached on the undersurface of the platen 14. As shown in FIG. 2, the guide plate 17 partially protrudes toward the front (i.e., a left-hand side of FIG. 2) of the platen 14.

Figure 3:
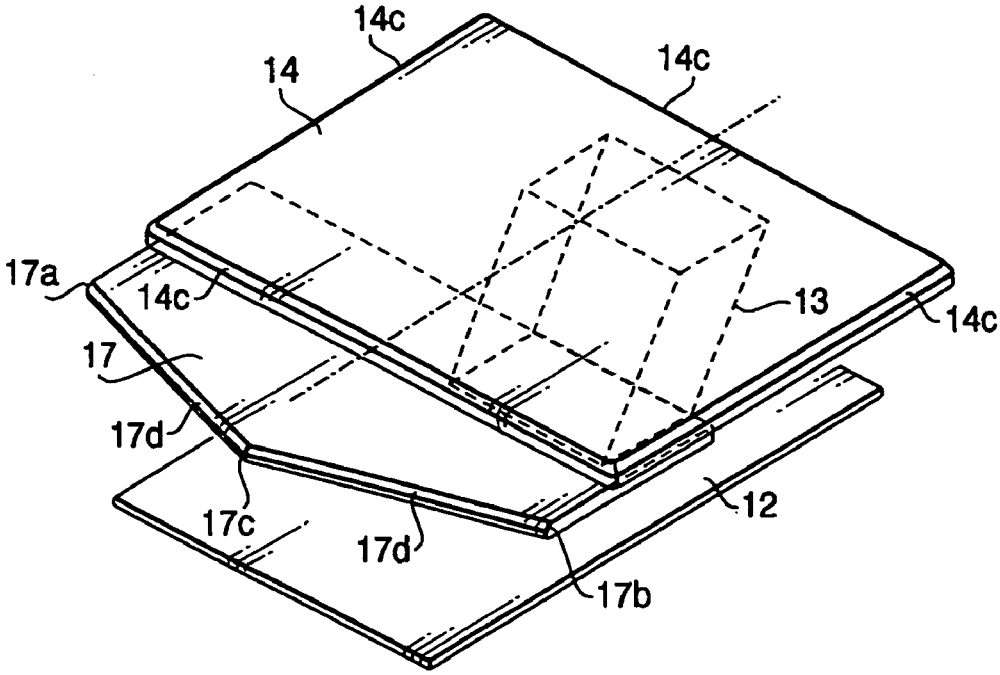
FIG. 3 is a perspective view of a part of the fabric printing apparatus shown in FIG. 1.
Figure 4:
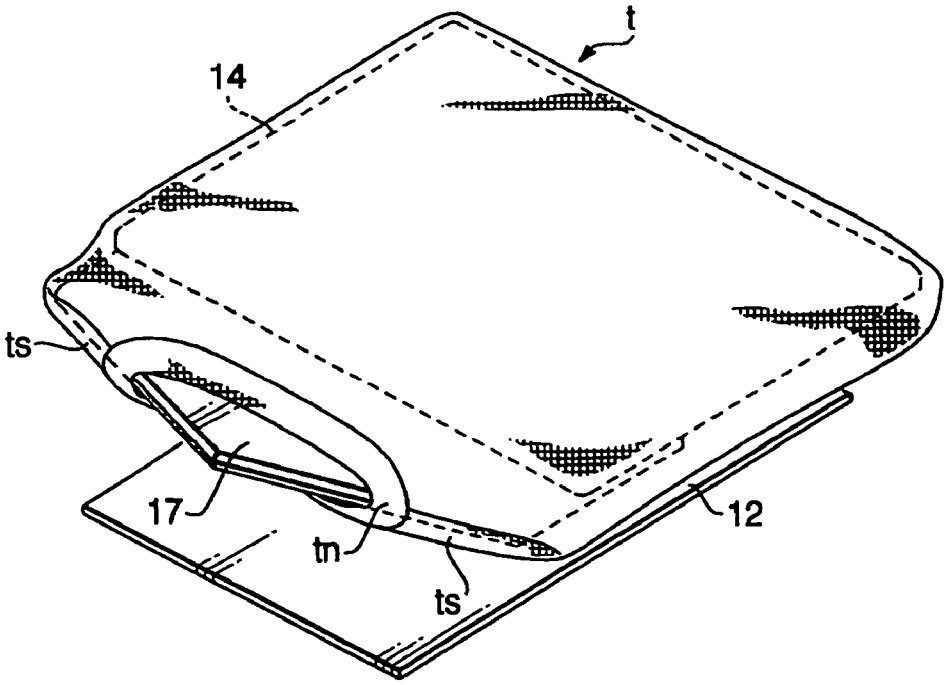
FIG. 4 shows a perspective view of the part of the fabric printing apparatus shown in FIG. 3 with a T-shirt set on a platen.

FIG. 3 is a perspective view of a part of the fabric printing apparatus 1 including the platen 14 and the guide plate 17. FIG. 4 shows a perspective view of the part of the fabric printing apparatus 1 shown in FIG. 3 with a T-shirt t set on the platen 14.

As shown in FIG. 3, the front end of the guide plate 17 is formed in a dull V-like shape having a right corner 17*a*, a left corner 17*b*, a middle corner 17*c*, and inclined edges 17*d* defined between the middle corner 17*c* and the right and left corners 17*a* and 17*b*.

The T-shirt t is set on the platen 14 from the front end of the T-shirt t so that the middle corner 17*c* passes through the neck tn of the T-shirt t and the neck tn is supported at the inclined edges 17*d* while the shoulders ts of the T-shirt t are supported at the left and right corners 17*a* and 17*b*. In this way, the T-shirt t can be positioned so that the portion where an image is to be printed (e.g. chest or back portion of the T-shirt t) is atop the working area of the platen 14.

Referring back to FIG. 2, the fabric printing apparatus 1 further includes a platen moving mechanism 20 for reciprocating the platen 14 in a direction perpendicular to a plane of FIG. 1 is drawn (i.e., in a direction perpendicular to the main scanning direction of the carriage 4, or an auxiliary scanning direction).

The platen moving mechanism 20 includes, as shown in FIG. 2, a pair of pulleys (21, 22), one disposed near the front side (i.e., the left-hand side in FIG. 2) of the fabric printing apparatus 1 and the other one near the rear side (i.e., in the right-hand side). The platen moving mechanism 20 further includes an endless belt 23 wound around the pair of pulleys (21, 22), a platen moving motor 24 for moving one of the pulleys, 22, and a fixing member 25 for fixing the sliding base 12 to the endless belt 23 at a suitable position. The platen moving mechanism 20 arranged as above actuates to horizontally reciprocate the platen 14 in the auxiliary scanning direction.

The fabric printing apparatus 1 has a casing 15 for covering and thereby protecting the endless belt 9, the inkjet heads 5, the slide mechanism 11 and the platen moving mechanism 20. Note that the casing 15 is illustrated by chain double-dashed lines, or imaginary lines, so that the configuration inside the casing 15 can be shown in detail in FIG. 1. A front side of the casing 15 is provided with an operation panel 16, which includes a liquid crystal display and operation buttons (such as a print start key 16*a* and the like) at an upper part of a right-hand-side thereof in FIG. 1.

In the fabric printing apparatus 1 arranged as described above, printing is carried out in the following manner.

The fabric printing apparatus 1 is connected with a host apparatus, which is a personal computer in the present embodiment. When the fabric printing apparatus 1 receives a printing command from the host apparatus, a not shown controller of the fabric printing apparatus 1 operates the platen moving motor 24 so that the platen 14 protrudes toward the front of the fabric printing apparatus 1.

Then, the user of the fabric printing apparatus 1 set a T-shirt t on the platen 14 from the front side of the platen 14 as shown in FIG. 5. The T-shirt t is set on the platen 14 so that the neck tn is supported at the inclined edges 17*d* of the guide plate 17 and the shoulders ts are supported at the left and right corners 17*a* and 17*b* of the guide plate 17 (see FIG. 4 and FIG. 6). As a result, the T-shirt t is suitably positioned on the platen 14.

When the T-shirt t is set on the platen 14 as shown in FIG. 6, the user depresses the print start key 16*a* on the operation panel 16 to start printing. The controller of the fabric printing apparatus 1 that has detected the above-mentioned operation actuates the platen moving motor 24 so that the platen 14 moves intermittently in the auxiliary scanning direction (in the direction shown by a double headed arrow in FIG. 7) by a line width at a time. The controller also actuates the carriage motor 8 to reciprocate the carriage 4 in the main scanning direction in synchronization with the intermittent movement of the platen 14 in the auxiliary scanning direction. Further, the controller applies voltage to the piezoelectric actuator of the inkjet head 5 so that line printing is carried out and a desired image is printed on the T-shirt t.

It should be noted that, during printing, the inkjet head 5 is moved across the platen 14 with a predetermined distance g1 being kept with respect to the platen 14 (see FIG. 7). The distance g1 should be greater than the thickness of the fabric of the T-shirt t. However, if the distance g1 is too large, the quality of the image printed on the T-shirt t deteriorates. Generally, the distance g1 is determined, with taking the thickness of the fabric of the T-shirt t into consideration, to a sufficiently small value, which may be about 3 mm, for example.

It should be noted, however, that sewn fabric such as the T-shirt t has a locally thick portion around the neck at which the fabric is folded and then sewn. In many cases, the shoulders of sewn fabric are also thick since they have seams.

Since the distance g1 between the platen 14 and the inkjet head 5 is small, the above-mentioned thick portions of the sewn fabric may come into contact with the inkjet head 5 if the inkjet head 5 passes above the thick portions during printing, and hence the thick portion may be contaminated with ink.

In the present embodiment, in order to avoid the above problem, the guide plate 17 for supporting the neck tn and the shoulders ts of the T-shirt t is located slightly lower than the platen 14. In other words, the guide plate 17 is provided to the fabric printing apparatus 1 so that the distance between the guide plate 17 and the inkjet head 5, g2 (see FIG. 7), is sufficiently greater than the distance g1 between the platen 14 and the inkjet head 5 (g1<g2) so that the thick portions will not contact the inkjet head 5.

In the present embodiment, the thick portions of the T-shirt, i.e. the portions around the neck tn and the shoulders ts, are supported on the guide plate 17, which is disposed sufficiently lower than the inkjet head 5. Thus, the thick portions of the T-shirt will not contact the inkjet head 5 during printing. Accordingly, the T-shirt t will not be contaminated with ink and/or the inkjet head 5 will not be clogged.

As shown in FIG. 3, the platen 14 is a rectangular plate having four sides. An upper surface side edge of each side of the platen 14 is formed to have a rounded face 14*c*, which is smoothly connected with the upper surface of the platen 14. With this configuration, portions located at the sides of the T-shirt t are prevented from floating up from the platen 14, which will be described in detail with reference to FIGS. 8A and 8B.

FIGS. 8A and 8B schematically illustrate the condition of the T-shirt t at an edge of the platen 14 having an angled (i.e., non-rounded) edge and a rounded edge, respectively. As shown in FIG. 8A, when the edge of the platen 14 is not rounded, the T-shirt t hanging down at the side is sharply bent at the edge and thus a portion on the platen 14 may partially float up from the edge. This floating portion of the T-shirt T may come into contact with the inkjet head 5 traveling across the platen 14 and causes the T-shirt t to be contaminated with ink.

In contrast to the above, when the edge of each side of the platen 14 is rounded as shown in FIG. 8B, the T-shirt t gradually bends along the rounded edge and does not float up from the upper surface of the platen 14. Thus, the T-shirt t will not come into contact with the inkjet head 5 during printing.

It should be noted that the inclined sides 17*d* at the front end of the guide plate 17 are also formed with rounded edges. Thus, the front end of the guide plate 17 does not have any sharp edge and hence the T-shirt will not be damaged by the guide plate 17 when the neck tn and the shoulders ts are pressed thereagainst in order to correctly position the T-shirt t on the platen 14.

The guide plate 17 is formed to have a symmetric shape with respect to a centerline thereof extending in the auxiliary scanning direction of the fabric printing apparatus 1. As T-shirts are generally made symmetric, the T-shirt t can be centered on the platen 14 with ease by the assist of the guide plate 17, and hence misalignment of the printed image can be prevented.

FIG. 9 schematically illustrates a structure of a fabric printing apparatus 50, which is a modification of the fabric printing apparatus 1. Note that elements substantially the same as those shown in FIGS. 1 through 8B are denoted by the same reference numbers in FIG. 9 and description thereof will not be repeated.

The fabric printing apparatus 50 has substantially the same structure as the fabric printing apparatus 1 except that a guide plate 57 is attached to a platen 54 such that the relative position of the guide plate 57 to the platen 54 can be changed.

The shape of the platen 54 is similar to the platen 14 of the first embodiment. As shown in FIG. 9, the platen 54 of the fabric printing apparatus 50 is provided with a screw shaft 31. The screw shaft 31 is fixed perpendicularly on the undersurface of the platen 54. The guide plate 57 has the same shape as the guide plate 17 of the first embodiment. Corresponding to the screw shaft 31 of the platen 54, the guide plate 57 is formed with an elongated through hole 32, which extends in the auxiliary scanning direction of the fabric printing apparatus 1 and has a width slightly larger than the diameter of the screw shaft 31. The guide plate 57 is placed below the platen 54 with the screw shaft 31 passed through the slit 32. A thumbscrew 33 is screwed on the screw shaft to secure the guide plate 57 to the platen 54.

By loosening the thumbscrew 33 and sliding the guide plate 57 relative to the platen 54 in the auxiliary scanning direction, the protruding length of the guide plate 57 with respect to the platen 54 can be changed (adjusted). When the guide plate 57 is located at a desired position, the guide plate 57 can be fixed thereat by tightening the thumbscrew 33.

With use of the position-adjustable guide plate, the fabric printing apparatus can be used for printing images on different positions of the T-shirt in accordance with design requirements and also for printing images on T-shirts of different sizes.

Second Embodiment

Hereinafter, a fabric printing apparatus according to a second embodiment of the invention will be described. Note that, hereinafter, elements substantially the same as those referred to in the first embodiment will be denoted by the same reference numbers and detailed description thereof will be omitted.

FIGS. 10 and 11 are a front view and a side view, respectively, of a fabric printing apparatus 100 according to a second embodiment of the invention.

The fabric printing apparatus 100 includes a structure similar to the fabric printing apparatus 1. That is, the fabric printing apparatus 100 has the frame 2, which includes the horizontal portion 2*h* and the vertical portions 2*v*, and the slide rail 3 supported between the vertical portions 2*v*. The fabric printing apparatus 100 is further provided with the carriage 4 slidably supported on the slide rail 3, and four piezoelectric inkjet heads 5 mounted on the carriage 4. The carriage is coupled with the endless belt 9 wound around the pair of pulleys 6 and 7. The pulley 6 is coupled with the spindle of the carriage motor 8. The carriage 4 reciprocates linearly along the slide rail 3 as the carriage motor 8 rotates the pulley 6 in normal and reverse directions.

Each inkjet head 5 are supplied with ink of different color from respective ink tanks 18 held by the mounting portions 10.

The fabric printing apparatus 100 is provided with the slide mechanism 11 supporting the sliding base 12. The fabric printing apparatus 100, however, differs from the fabric printing apparatus 1 according to the first embodiment in that a height adjusting mechanism 102 is provided on the sliding base 12, which is arranged to support a main platen 104 at two different heights.

A horizontal flat working area is defined on the upper surface of the main platen 104. Clothes can be set on the main platen 104 with the side to be printed spread over the working area without any wrinkle.

According to the second embodiment, the main platen 104 is not provided with the guide plate 17. Of course, the invention need not be limited to this configuration, and the guide plate may be optionally employed in the second embodiment.

FIG. 12 is a perspective view of a part of the fabric printing apparatus 100 including the main platen 104. FIG. 13 shows a perspective view of the part of the fabric printing apparatus shown in FIG. 12 with a T-shirt t set on the main platen 104.

As shown in FIG. 12, the front end of the main platen 104 is formed into a V-like shape having a right corner 104*a*, a left corner 104*b*, a middle corner 104*c*, and inclined sides 104*d* defined between the middle corner 104*c* and the right and left corners 104*a* and 104*b*. It should be noted that, in the second embodiment, the main platen 104 is configured to have the V-like shape. However, the structure of the platen 104 need not be limited to this shape, and for example, a platen having the structure as in the first embodiment (i.e., the platen 14 provided with the guide member 17) can be employed instead of the platen 104.

The T-shirt t is set on the main platen 104 from the front end thereof until the middle corner 104*c* passes through the neck tn of the T-shirts t and the neck tn is supported at the inclined sides 104*d* while the shoulders ts of the T-shirt t are supported at the left and right corners 104*a* and 104*b* as shown in see FIG. 13. In this way, the portion of the T-shirt t to be printed (e.g. chest portion or back portion of the T-shirt) can be centered on the working area of the main platen 104. Note that the portions of the T-shirt lying off the main platen 104 are folded down below the main platen 104 so that they do not hinder printing.

Referring back to FIG. 11, the fabric printing apparatus 100 further includes the platen moving mechanism 20 for reciprocating the main platen 104 in the auxiliary scanning direction. The platen moving mechanism 20 has the same configuration as that in the first embodiment of the invention and hence detailed description thereof will be omitted.

The fabric printing apparatus 1 also has the casing 15, which is provided with the operation panel 16 (see FIG. 10). Similar to the fabric printing apparatus 1, the operation panel 16 of the fabric printing apparatus 100 includes a liquid crystal display and operation buttons such as the print start key 16*a*.

The fabric printing apparatus 100 is connected with a host apparatus (not shown), which is a personal computer in the present embodiment. When the fabric printing apparatus 100 receives a printing command from the host apparatus, a controller 178 (see FIG. 30) of the fabric printing apparatus 100, which will be described later, operates the platen moving motor 24 so that the main platen 104 moves forward and protrudes from the fabric printing apparatus 100.

When the main platen 104 is protruded from the fabric printing apparatus 100 as above, the user can set the T-shirt t on the main platen 104 from the front of the main platen 104 as shown in FIG. 14. The T-shirt t is set on the main platen 104 so that the neck tn is supported at the inclined edges 104*d* and the shoulders ts are supported at the left and right corners 17*a* and 17*b* (see FIG. 15 and FIG. 13). As a result, the T-shirt t is suitably positioned on the main platen 104.

When the T-shirt t is set on the main platen 104 as shown in FIG. 15, the user depresses the print start switch 16*a* on the operation panel 16 to start printing. The controller 178 of the fabric printing apparatus 100 that has detected the above-mentioned operation actuates the platen moving motor 24 and the carriage motor 8 so that the main platen 104 moves intermittently in the auxiliary scanning direction while the carriage 4 reciprocates in the main scanning direction. The controller 178 also applies voltage to the piezoelectric actuators of the inkjet heads 5 so that line printing is carried out. By repeating the above operation to print the image line by line, a desired image is printed on the T-shirt t.

During printing, the inkjet heads 5 are moved above the main platen 104 with the distance g1 from the main platen 104 kept small, e.g. about 3 mm (see FIG. 16).

The fabric printing apparatus 100 according to the second embodiment of the invention further includes an additional platen 106 which can be detachably mounted on the main platen 104.

FIG. 17 shows a perspective view of the additional platen 106. The additional platen 106 includes a clamp portion 108 and a work plate 110. The clamp portion 108 has a shape similar to a clevis and has a long upper plate 112 and a short lower plate 114 extending in parallel with each other. A screw hole 116 is formed through the lower plate 114 and a screw 118 is screwed in into the screw hole 116. A knob 120 is fixed on one end of the screw 118, which allows the screw 118 to be turned by fingers.

The upper plate 112 of the clamp portion 108 has a front end 112*a* and a rear end 112*b*. An elongated supporting plate 122 is fixed on the upper plate 112 in a vicinity of the rear end 112*b*. The supporting plate 122 supports the work plate 110 at a rear end thereof such that a gap is formed between the upper plate 112 and the work plate 110. The work plate 110 is supported such that it is parallel to the main platen 104 when the additional platen 106 is attached to the main platen 104.

The front end 110*a* of the work plate 110 is formed into a V-like shape. Thus, the work plate 110 can be inserted into a small pouched portion of a fabric, such as a pocket, with ease.

A flat horizontal working area is defined on the upper surface of the work plate 110. Clothing can be set on the work plate 110 with the side to be printed being spread over the working area without any wrinkle.

The additional platen 106 can be attached to the main platen 104 so that the side edge of the main platen 104 is placed between the upper and lower plates (112, 114) of the clamp portion 108 and then tightening the screw 118.

FIG. 18 shows the additional platen 106 mounted on the main platen 104. As shown in FIG. 18, the main platen 104 may be provided with a mark M for indicating the position in the auxiliary scanning direction at which the additional platen 106 should be attached. Such a mark M assists in attaching the additional plate 104 to the main platen 14 at the correct position. Accordingly, an image to be printed can be formed on the right position of the fabric set on the additional platen 106.

The mark M may be a triangle formed on the top face of the main platen 104 so that one of the corners of the triangle indicates the position at which the additional platen 106 should be placed. The additional platen 106 can be located in place in the auxiliary direction by adjusting the front end of the upper plate 112, for example, to the above-mentioned corner of the mark M.

It should be noted that the positioning of the additional platen 106 in the main scanning direction can be achieved by abutting a side wall (vertical portion) 112*c* of the clamp portion 108 against the side edge of the main platen 104.

It should also be noted that the mark M is not limited to a triangular mark but may take any other suitable form. Exemplary marks that can be used include a line, a point, a circle, an L-like shape figure, or a line indicating the outline of the upper plate 112 of the additional platen 106 on the main platen 104. The position may be indicated by changing colors on the upper surface of the platen 104.

The mark M may be formed on any place of the main platen 104 as far as the user can visually adjust the position of the additional platen 106 thereto. Thus, the mark M may be formed not only on the upper surface of the main platen 104 but also on the side or undersurface thereof.

The mark M may be formed by painting, by bonding a thin plate or a sticker, or by forming a protrusion or a recess on the main platen 104.

It should be noted that another additional mark may be formed on the main platen 104 that can be used for positioning the additional platen 106 in the main scanning direction.

The additional platen 106 is used when a T-shirt t' having a pocket tp is to be printed (see FIG. 19A). The T-shirt t' can be set on the additional platen 106 in the following manner. First, as shown in FIGS. 19A and 19B, the T-shirt t' is laid with the front side up. Then, the neck and shoulders are folded down along the mouth of the pocket tp (along a line L1 shown in FIG. 19A). Then, the T-shirt t' is set on the additional platen 106 such that the pocket tp covers the work plate 110 from the front end 110*a* thereof and such that the body of the T-shirt t' is inserted between the work plate 110 and the clamp portion 108. As shown in FIG. 20, the work plate 110 is covered with the pocket tp until the pocket tp reaches the rear end of the work plate 110 and the body of the T-shirt t' abuts the supporting plate 122. The portions of the T-shirt t' lying off the platen 104 are folded down below the main platen 104 so that they do not hinder printing.

By setting the pocket tp of the T-shirt t' on the additional platen 106 as above, the pocket tp can be correctly positioned and hence printing an image on the pocket out of position can be prevented.

It should be noted that, since the additional platen 106 is detachably attached to the main platen 104, printing on the chest portion or back portion of the body of the T-shirt t' is also possible by removing the additional platen 106 and setting the body of the T-shirt t' directly on the main platen 104. Thus, the fabric printing apparatus 100 can be used in many ways.

It should be noted that, since the positioning of the T-shirt t' is carried out by folding the T-shirt t' along the entrance of the pocket tp and covering the work plate 110 with the T-shirt t' until the folded portion thereof comes into contact with the supporting plate 122, the pocket tp can be correctly positioned on the additional platen 106 in the auxiliary scanning direction. Therefore, the fabric printing apparatus 100 can print an image on the pocket tp in place.

As may be understood from FIG. 18, the work plate 110 of the additional platen 106 is placed much higher than the main platen 104. Therefore, the work plate 110 interferes with the inkjet head 5, which travels slightly above the main platen 104. In order to avoid the interference between the work plate 110 and the inkjet head 5, and in order to allow the inkjet head 5 print an image on the portion spread on the additional platen 106, the fabric printing apparatus 100 is provided with the height adjusting mechanism 102.

Referring back to FIGS. 10 and 12, the height adjusting mechanism 102 includes a base cylinder 130 and a rotating cylinder 132. The base cylinder 130 is fixed perpendicularly on the sliding base 12 and supports a shaft 140 extending downward from the main platen 104 and inserted into the base cylinder 130. The rotating cylinder 132 is rotatably mounted on the base cylinder 130 and is provided with a horizontally extending lever 134 for controlling the angular position of the rotating cylinder 132.

A supporting rod 142 extends downward from the main platen 104 from a position near the shaft 140. The lower end of the supporting rod 142 is in contact with the top face of the rotating cylinder 132.

The top face of the rotating cylinder 132 includes a first surface r1, a second surface r2 that is lower than the first surface r1, and an oblique surface q connecting the first and second surfaces r1 and r2. When the rotating cylinder 132 is rotated right and left around the base cylinder 130 by operating the lever 134, the supporting rod 142 slides on the top face of the rotating cylinder 132 from the first surface r1 to the second surface r2, and vice versa.

When the supporting rod 142 is on the first surface r1 of the rotating cylinder 132, the supporting rod 142 supports the main platen 104 below the inkjet head 5 by the distance g1, which is suitable for printing on a fabric set on the main platen 104 (see FIG. 13).

When the lever 134 is operated so that the supporting rod 142 slides down along the oblique surface q from the first surface r1 to the second surface, the main platen 104 gradually moves down. As the supporting rod 142 reaches the second surface r2, the main platen 104 is located at a height at which the vertical distance between the inkjet head 5 and the additional platen 106 (or the work plate 110 thereof) attached to the main platen 104 is equal to the distance g1 (see FIG. 21).

As above, the height adjusting mechanism 102 can suitably adjust the heights of the main platen 104 and the additional platen 106 relative to the inkjet head 5 to allow clear printing on a fabric irrespective of whether the fabric is set on the main platen 104 or on the additional platen 106.

It should be noted that the dimension of the work plate 110 of the additional platen 106 may be determined in accordance with the size of the pocket tp to be printed, and hence the fabric printing apparatus 100 may include several different additional platens 106 each having a work plate of a different size.

FIGS. 22A and 22B show two different additional platens 106*s* and 106*b*, which have substantially the same structures except for the size of the work plate.

When the fabric printing apparatus 100 includes different additional platens (106*s*, 106*b*), an identifying plate 150 is optionally attached to each additional platen (106*s*, 106*b*). In the examples shown in FIGS. 22A and 22B, the identifying plate 150 has four identifying areas 150*a*, 150*b*, 150*c* and 150*d* on one side thereof. The four areas 150*a*-150*d* form a four-digit pattern. Preferably, at least one of the identifying areas 150*a* through 150*d* is cut off to form the pattern. The identifying plate 150 indicates the type of the additional platen (106*s*, 106*b*), or the size of the work plate (110*s*, 110*b*).

For example, in the additional platen 106*s*, which is provided with a small size work plate 110*s*, the identifying areas 150*b* and 150*d* are cut off so that the identifying areas 150*a* and 150*c* form protrusions on the side of the identifying plate 150. In the additional platen 106*b*, which has a relatively large size work plate 110*b*, the identifying areas 150*c* and 150*d* are cut off and the identifying areas 150*a* and 150*b* are left.

It should be noted that the plurality of additional platens may have different shapes. The "size" of the platens described above is an example of the different shapes.

The fabric printing apparatus 100 may be provided with four sensors 160 for reading the pattern formed on the identifying plate 150. The four sensors 160 may be disposed below the main platen 104 at locations corresponding to the identifying areas (150*a*, 150*b*, 150*c* and 150*d*) of the additional platen 106*s* or 106*b* attached to the main platen 104 so that each sensor 160 can detect whether the corresponding identifying area (150*a*, 150*b*, 150*c* and 150*d*) is cut away or left. Note that the sensors 160 may detect the presence/absence of the corresponding identifying areas (150*a*, 150*b*, 150*c*, 150*d*) either optically, electronically, or mechanically. It should be also noted that the number of the identifying areas may be determined in accordance with the number of the types of the additional platens. Further, the sensor 160 may also be used to detect whether the additional platen is mounted or not.

The sensors 160 are electrically connected with the controller of the fabric printing apparatus 100. The output of the sensors allows the controller to determine the size of the work plate 110 of the additional platen 106 currently attached to the main platen 104. The controller, which has obtained the size of the work plate 110, may enlarge or reduce the size of the image to be printed on the pocket tp in accordance with the size of the work plate 106 and/or adjust the printing location of the image on the center of the pocket tp.

It should be noted that although the pattern formed by the identifying areas (150*a*, 150*b*, 150*c* and 150*d*) indicates the size of the work plate 110 in the present embodiment, the pattern may also indicate the shape of the pocket tp to be set on the work plate 110 (whether the pocket tp is an elongated one or a wide one). The property to be identified need not be limited to the size of the work plate and the shape of the pocket, but any other information may be represented by the identifying areas optionally or alternatively.

It should also be noted that a reference point 0 is defined on each of the work plates 110*s* and 110*b*. The reference point O serves as an origin for determining the position of the image to be printed on the pocket tp. Each of the work plates 110*s* and 110*b* is mounted on the clamp portion 108 so that the reference point O is located at a fixed point relative to the main platen 104 when the additional platen 106*s* or 106*b* is attached to the main platen 104 (see FIG. 23).

As the origin O is located at a predetermined point irrespective of the type of the additional platen 106 mounted on the main platen 104, the fabric printing apparatus 100 is not required to re-calculate the position of the image to be printed when the additional platen 106 is exchanged to another one, resulting in less calculation load on the fabric printing apparatus 100.

FIGS. 24 and 25 show perspective views of additional platens 106*x* and 106*y*, respectively, which are further modifications of the additional platen 106 shown in FIG. 17. The additional platens 106*x* and 106*y* has substantially the same configuration as the additional platen 106 except that each of them is provided with a sensor that detects whether the pocket tp of the T-shirt t' to be printed in set thereon.

In the additional platen 106*x* shown in FIG. 24, a limit switch (sensor) 170 is attached on a rear face of the supporting plate 122. The limit switch 170 is connected with the controller 178 of the fabric printing apparatus 100. A contact rod 172 of the limit switch 170 penetrates through the supporting plate 122 and protrudes horizontally into a space defined between the work plate 110 and the clamp portion 108.

In the additional platen 106*y* shown in FIG. 25, the limit switch 170 is attached to a side face of the clamp portion 108 such that the contact rod 172 extends upward to protrude higher than a plane of the upper plate 112. The limit switch 170 is connected with the controller 178 of the fabric printing apparatus 100.

In either case, when the pocket tp is set on the work plate 110, the body of the T-shirt inserted below the work plate 110 presses the contact rod 172 to turn on the limit switch 170. Thus, the fabric printing apparatus 100 can detect that the T-shirt t' being set on the additional platen (106*x* or 106*y*) based on the output of the limit switch 170.

It should be noted that, when the additional platens (106*x* or 106*y*) provided with the limit switch 170 is utilized, the fabric printing apparatus 100 can be configured to start printing only when the limit switch 170 is turned on. With this configuration, ejection of ink from the inkjet heads 5 when the T-shirt t' is not set on the additional platens (106*x*, 106*y*) thereby making the additional platens (106*x*, 106*y*) dirty can be prevented.

It should be noted that the sensor for detecting the T-shirt t' provided to the additional platen is not limited to the limit switch 170. Alternatively, an optical system may be provided, which may include a light emitting diode mounted on the undersurface of the main platen 104 and a light sensor attached to the clamp portion 108 so that it opposes the light emitting diode. With such an optical system, the T-shirt t' can be detected as is set on the work plate 110 and blocks the light emitted from the light emitting diode.

It should be noted that a plurality of additional platens 106*x* may be attached to the main platen 104. For example, as shown in FIG. 26, a pair of additional platens (106*x*, 106*x*') may be attached to the main platen 104 on the right and left sides thereof, respectively. In this case, the two additional platens (106*x*, 106*x*') are configured symmetrically to each other as shown in FIG. 26. Further, the mark M for the additional platen 106*x*' is provided on the main platen 104. Attaching the pair of additional platens (106*x*, 106*x*') to the main platen 104 as above, allows the fabric printing apparatus 100 to simultaneously print on pockets tp of two separate T-shirts t'.

FIGS. 27, 28, and 29 schematically illustrate the manner of setting two T-shirts t' on the pair of additional platens (106*x*, 106*x*') shown in FIG. 26.

First, each T-shirt t' is folded along the entrance of the pocket tp so that the pocket tp comes on the top (see the upper part of FIG. 27). Then, one of the T-shirts t' is further folded along the right side of the pocket tp so that the pocket comes on the top while the other one is folded along the left side of the pocket tp (see the lower part of FIG. 27).

Next, as shown in FIG. 28, the two T-shirts t' are set on the additional platens (106*x*, 106*x*') so that each work plates 110 is inserted into the corresponding pocket tp to be covered with the pocket tp up to the rear end. Then, the portions of the T-shirts t' lying off the work plates 110 are folded down below the work plates 110 so that they do not hinder the subsequent printing (see FIG. 29).

It should be noted that, when multiple additional platens (106*x*, 106*x*') are attached to the main platen (104) and-a pocket is set to each additional platen, the fabric printing apparatus 100 is able to simultaneously print the images on multiple pockets tp and printing efficiency is improved.

It should be noted that, in the above example, the platens 106*x* and 106*x*' are mounted on the main platen 104. The invention is not limited to this configuration, and the platen 106, 106*s*, 106*b*, 106*y* and corresponding symmetrical platen may be used instead of the platens 106*x* and 106*x*'.

Next, the electrical configuration of the fabric printing apparatus 100 will be described with reference to FIG. 30.

As shown in FIG. 30, the controller 178 of the fabric printing apparatus 100 includes a central processing unit (CPU) 180 for integrally controlling each part of the fabric printing apparatus 100, a random access memory (RAM) 182 for temporally storing data, and a read only memory (ROM) 184 for permanently storing data such as control programs.

The controller 178 is connected with a print controlling circuitry 188 and a communication processor 190 via a data bus 186. The print controlling circuitry 188 includes an inkjet head driving circuit 192 for driving the inkjet heads 5, a carriage motor driving circuit 194 for driving the carriage motor 8, and a platen moving motor driving circuit 196 for driving the platen moving motor 24.

The print controlling circuitry 188 further includes a sensor signal receiving circuit 198, which is connected with various kinds of sensors provided on the fabric printing apparatus 100, such as the print start key 16*a* on the operation panel 16, the limit switches 170 on the additional platen (106*x*, 106*x*', 106*y*), and the sensors 160 for discriminating the type of the additional platen (106*s*, 106*b*).

The communication processor 190 is connected with host apparatus, which is a personal computer 200 in the present embodiment, via a suitable cable. The communication processor 190 serves as an interface that relays the print operation commands from the personal computer 200 to the fabric printing apparatus 100 and transmits information on the state of the fabric printing apparatus 100 to the personal computer 200.

The user can create and edit an image by using an image edit program that works on the personal computer 200. When the printing function of the image edit program is executed, the personal computer 200 creates an image processing control data that includes data necessary for printing such as the image data and the size of the fabric to be printed and transmits the image processing control data to the controller 178 through the communication processor 190 in response to the print operation command. The controller 178 interprets and develops the print operation command and sends a signal to start printing to the print controlling circuitry 188 when the print start key 16*a* is depressed.

FIG. 31 schematically illustrates a flow of image data when an image is printed on a chest portion or back portion of a T-shirt t. Firstly, the image processing control data, which includes the data of the image to be printed, is transmitted from the personal computer 200 to the fabric printing apparatus 100 through the communication processor 190 (arrow A1).

The RAM 182 of the controller 178 of the fabric printing apparatus 100 includes a memory area 182*a* and a buffer area 182*b*. The memory area 182*a* is utilized for interpreting and developing the image data contained in the image processing control data. The buffer area 182*b* is for temporarily storing the image data that is to be transmitted to the inkjet head driving circuit 192.

The capacity of the buffer area 182*b* is reserved large enough for storing data of an image that is as large as the main platen 104 which corresponds to a maximum size of image. The color information of each pixel of an image having a resolution of 300 dpi, for example, can be stored into the buffer area 182*b*.

The fabric printing apparatus 100 retrieves the image data from the image processing control data and develops it on the memory area 182*a*, which keeps the data temporarily. Then, the image data is copied to a suitable location of the buffer area 182*b* (arrow A2). Then, the image data in the buffer area 182*b* is divided into a plurality of pieces of line data, which are sent in sequence to the inkjet head driving circuit 192 (arrow A3), thereby the image being printed on the desired portion (i.e., the chest portion or the back portion) of the T-shirt t.

FIG. 32 schematically illustrates a flow of image data when pockets tp of two T-shirts t' are to be printed simultaneously using the additional platens 106*x* and 106*x*' (or, the platen 106, 106*s*, 106*b* or 106*y* and its symmetric counter member). Note that, in this case, the additional platens 106*x*' and 106*x* are mounted on the main platen 104 and the pockets tp of the two T-shirts t' are set thereon as shown in FIG. 29. It should be further noted that, in this case, the image processing control data includes only one image data since the same image is to be printed on the two pockets tp.

Similar to the data flow shown in FIG. 33, the image processing control data is transmitted from the personal computer 200 to the controller 178 of the fabric printing apparatus 100 (arrow A4), and the image data contained in the image processing control data is developed on the memory area 182*a* of the RAM 182. Then, the image on the memory area 182*a* is reversed upside down (arrow A5). This is because the orientation of the T-shirts t' set on the additional platens (106*x*, 106*x*') is opposite to that of the T-shirt t set on the main platen 104 (compare FIGS. 13 and 29).

Then, the reversed image is copied to two locations on the buffer area 182*b* (arrow A6), which correspond to the work plates 110 of the two additional platens 106*x* and 106*x*'. Then, the data stored in the buffer area 182*b* is transmitted to the inkjet head driving circuit 192 (arrow A7) so that the two images are printed on the pockets tp on respective work plates 110 of the additional platens 106*x* and 106*x*'.

It should be noted that, since the image processing control data includes data only for a single image even when two pockets tp are to be printed, the data amount to be transmitted from the personal computer 200 to the fabric printing apparatus 100, and hence the time required for data transmission can be reduced in the fabric printing apparatus 100 according to the present embodiment.

According to this modification, before copying the reversed image from the memory area 182*a* to the buffer area 182*b*, the state of each of the limit switches 170 of the additional platens (106*x*, 106*x*') may be checked and the reversed image may be copied only to the location of the buffer area 182*b* corresponding to the additional platen on which the pocket tp is currently set. For example, as shown in FIG. 33, when the pocket tp is set only on the right one (106*x*) of the two additional platen (106*x*, 106*x*'), the reversed image is copied only to the right location of the buffer area 182*b* (arrow A8), which corresponds to the right additional platen 106*x*'. With this configuration, the inkjet heads 5 are controlled to eject the ink only onto the additional platen on which the pocket is set. In other words, the fabric printing apparatus 100 can be controlled so that it prints an image only on one pocket, or images on both pockets simultaneously, depending on whether one or two pockets are set to the additional platens (106*x*, 106*x*').

It should be noted that the fabric printing apparatus 100 can simultaneously print on more than two pockets tp using more than two additional platens in order to improve the printing efficiency.

FIG. 34 shows a main platen 104', which is a further modification of the second embodiment, on which four additional platens are attached thereto. Two additional platens 106 are mounted on the right side 104'*a* of the main platen 104', spaced apart from each other by a suitable distance. Similarly, another two additional platens 106' are mounted on the left side 104'*b* of the main platen 104', spaced apart from each other by a suitable distance. Note that the additional platens 106' are configured similar to the additional platens 106 but are configured to have a symmetrical shape.

The main platen 104' is similar to the main platen 104 shown in FIG. 12 except that it is formed with two slits 210. The slits 210 respectively extend from the right and left sides 104'*a* and 104'*b* of the main platen 104' substantially in parallel with the main scanning direction of the fabric printing apparatus 100. One of the slits 210 is formed between the additional platens 106 mounted on the right side 104'*a* of the main platen 104' and the other between the additional platens 106' mounted on the left side 104'*b*. It should be noted that, the structure of the platen 104' need not be limited to this shape. In particular, the V-like shape portion of the platen 104' may be realized with use of an integrally provided guide member as in the platen 14 provided with the guide member 17 in the first embodiment.

The slits 210 formed on the main platen 104' allow the T-shirt, of which pocket is set on the additional platen (106, 106') nearer to the rear end 104'*c* of the main platen 104', to be folded down below the main platen 104' so that the T-shirt does not hinder the subsequent printing.

Note that, when the fabric printing apparatus 100 is provided with the main platen 104' shown in FIG. 34, i.e. the main platen 104' with four additional platens (106, 106') thereon, the controller 178 copies the image developed on the memory area 182*a* of the RAM 182 to four locations on the buffer area 182*b*, each corresponding to the location of respective one of the four additional platens (106, 106').

The number of the additional platens which can be mounted on the main platen need not be limited to two or four, and various modifications having various numbers of additional platens can be realized. In either case, similarly to fabric printing apparatus 100, the fabric printing apparatus receives data for only a single image, an a necessary number of copies are made when the printing is executed. Therefore, the data amount to be transmitted from the personal computer to the fabric printing apparatus, and the time required for data transmission can be reduced. Further, the efficiency in printing the images is improved.

It should be noted that the additional platens 106 and 106' may be replaced with the additional platens 106*x* and 106*x'*, or any other additional platens mentioned above may be utilized. In particular, when the additional platens 106*x* and 106*x'* are used, the fabric printing apparatus 100 can be controlled based on the states of the limit switches of respective additional platens 106*x* and 106*x'*.

The above-mentioned additional platens 106 and 106' may be utilized in pairs in order to print a pair of images on a pair of fabrics that are used in pairs, such as a pair of gloves or socks. FIGS. 35 and 36 schematically show the additional platens 106 and 106' attached to the main platen 104. In FIG. 35, a pair of gloves G are set on the additional platens 106 and 106', while in FIG. 36 a pair of socks S are set on the additional platens 106 and 106'. In these cases, different from the cases where the same images are printed on the pockets, a pair of symmetrical images are preferably printed on the pair of gloves G or socks S.

FIG. 37 schematically illustrates a flow of image data when a pair of symmetrical images are printed on fabric to be used in pairs, such as the a of gloves G, respectively.

Similar to the data flow shown in FIG. 31, firstly, the image processing control data is transmitted from the personal computer 200 to the controller 178 of the fabric printing apparatus 100 (arrow A10). The image data contained in the image processing control data is developed on the memory area 182*a* of the RAM 182. It should be noted that the image processing control data includes the image data only for a single image, which is to be printed on the left hand glove G for example.

Then the developed image is copied to the buffer area 182*b* on a location corresponding to the work plate 110 of the additional platen 106 holding the left glove G (arrow A11).

The image on the memory area 182*a* is also reversed (right to left) to create a mirror image. Then, the mirror image is copied to the buffer area 182*b* on a location corresponding to the work plate 110 of the additional platen 106' holding the right hand glove G (arrow A12).

Then, the data stored in the buffer area 182*b* is transmitted to the inkjet head driving circuit 192 so that the two symmetrical images are printed on the pair of gloves G, respectively.

It should be noted that, since the mirror image to be printed on the right hand glove G is created in fabric printing apparatus 100, the personal computer 200 is not required to create the mirror image and the image processing control data only need to contain data for a single image. As a result, the data amount to be transmitted from the personal computer 200 to the fabric printing apparatus 100 and hence time required for data transmission is reduced.

It should also be noted that it is not necessarily that the above-modification is limited to print symmetrical images. Images including letters such as "ABC" may be printed on both gloves without being reversed. Thus, the fabric printing apparatus 100 may be configured such that the same images or symmetrical images are selectively printed on the right hand glove G and left hand glove G in accordance with the type of the image, for example, by operating the operation panel 16.

FIG. 38 schematically shows a configuration of a fabric printing apparatus 300, respectively, which is a variation of the fabric printing apparatus 100 shown in FIG. 10, and FIGS. 39A and 39B show perspective views of a first platen 302 and a second platen 304, which can be detachably attached to the fabric printing apparatus 300. In FIG. 38, the fabric printing apparatus 300 provided with the first platen 302 is shown.

The first platen 302 shown in FIG. 39A is configured similar to the main platen 104. The first platen 302 has a rear end 302*a*, a right end 302*b*, a left end 302*c*, and a V-like shaped front end 302*d*. Note that the first platen 302 is provided with a supporting shaft 306 extending downward from the undersurface thereof. The top face of the first platen 302 serves as a first work plane 302*e* on which the portion of a T-shirt to be printed (i.e., chest portion or back portion) can be spread. It should be noted that, the structure of the platen 302 need not be limited to the shape shown in FIG. 39A. In particular, the V-like shape portion of the platen 302 may be realized with use of an integrally provided guide member as in the platen 14 provided with the guide member 17 in the first embodiment.

The second platen 304 shown in FIG. 39B is configured to support two small size objects such as gloves, socks, or pockets of T-shirts. The second platen 304 is a flat plate having two work plates 312 and 314. The top faces of the work plates 312 and 314 serve as second work planes 312*a* and 314*a* on which a small fabric can be set. A supporting shaft 316 extends downward from a middle portion 318 of the flat plate disposed between the two work plates 312 and 314.

The fabric printing apparatus 300 includes a base cylinder 320 fixed on the base plate 12. The base cylinder 320 is arranged so that the supporting shafts (306, 316) of the first and second platens 302 and 304 can be detachably inserted therein. Thus, the first and second platens (306, 316) can be exchanged, as needed, by merely pulling/inserting the supporting shafts thereof from/into the base cylinder 320.

Note that the fabric printing apparatus 300 is arranged similar to the fabric printing apparatus 100 except what is described above.

When a T-shirt is to be printed, the first platen 302 can be attached to the fabric printing apparatus 300. The T-shirt can be set on the first platen 302 in the manner that is previously described in connection with FIGS. 14 and 15.

When images are printed on the pockets of the T-shirts, the second platen 304 can be attached to the fabric printing apparatus 300 and the pockets are set on the work plates (312, 314) of the second platen 304. In this case, the T-shirts can be folded in the manner that is previously described in connection with FIG. 27, and the pockets can be set on the work plates (312, 314) in a manner similar to that shown in FIGS. 28 and 29.

As above, the fabric printing apparatus 300 shown in FIG. 38 can print the images on a T-shirt by attaching the first platen 302 thereto and also images on a pocket of the T-shirt by attaching the second platen 304 thereto. Thus, the fabric printing apparatus 300 can be widely used for various kinds of fabrics. It should also be noted that, when the second platen 304 is used, the pocket of the T-shirt can be positioned in place and the image can be printed on the pocket without any displacement.

It should be noted that, when the first platen 302 is attached to the fabric printing apparatus 300, the flow of the image data in the fabric printing apparatus 300 when the printing is executed is the same as the flow described in connection with FIG. 31.

Further, when the second platen 304 is attached to the fabric printing apparatus 300, the flow of the image data is the same as that described in connection with FIG. 32. That is, the image data included in the image processing control data is first developed on the memory area 182*a* of the RAM 182 and then reversed upside down. Next, the reversed image is copied to two locations on the buffer area 182*b*, which correspond to the work plates 312 and 314, respectively. Then, the data stored in the buffer area 182*b* is transmitted to the inkjet head driving circuit 192 so that the two images are printed on respective pockets tp set on work plates 312 and 314. Alternatively, the flow may be the same as that shown in FIG. 33.

It should also be noted that the second platen 304 may be provided with sensors such as the limit switches 48 shown in FIG. 24 to detect whether or not pockets are currently set on the work plates 312 and 314. In this case, the limit switches 48 may be mounted on the undersurfaces of the work plates 312 and 314. When the second platen 304 is provided with the limit switches 48, the fabric printing apparatus 300 may be operated so that it prints only on the work plate (312, 314) of which limit switch 48 has detected the fabric. In this way, the fabric printing apparatus 300 can be prevented from printing on the work plate on which a fabric is not set.

FIG. 40 shows a variation of the second platen 304. The number of the work plates of the second platen 304 is not limited to two but may be one or more than two as shown in FIG. 40 in which a platen 330 provided with four work plates 332, 334, 336, and 338 is shown.

While the invention has been described in detail with reference to specific embodiments thereof, it would be apparent to those skilled in the art that various changes and modifications may be made therein without departing from the scope of the invention, which is defined by the attached claims.

The object on which images are printed by the fabric printing apparatus 1 shown in FIG. 1 is not limited to T-shirts. Any other sewn fabric which can be accurately positioned by the guide plate 17 may be subject to be printed. In particular, the fabric printing apparatus 1 is convenient for printing images on a fabric having a neck and shoulders are.

The rounded edges of the sides (14*c*, 17*c*) of the platen 14 and the guide plate 17 of the fabric printing apparatus 1 may be either a part of a circle or a part of an ellipse.

The front end of the guide plate 17 of the fabric printing apparatus 1 may be formed into an arc-like shape, instead of the V-like shape. Further, the guide plate 17 may be replaced with a block member (a thick plate) having the same horizontal section as the guide plate 17.

The configuration of the fabric printing apparatus 1 for adjusting the protruding length of the guide plate 57 from the platen 54 is not limited to that shown in FIG. 9, but any other suitable arrangement may be employed. For example, a pair of rails extending in the auxiliary scanning direction may be provided on the undersurface of the platen 54, and the guide plate 57 may be slidably mounted thereon. Alternatively, the guide plate 57 and the platen 54 may be configured such that the guide plate 57 can be detachably secured on the undersurface of the platen 54 at several different locations in the auxiliary scanning direction.

The guide plate 17 of the fabric printing apparatus 1 may be detachably secured to the platen 14 so that the guide plate 17 can be removed to allow the fabric printing apparatus 1 to print on a fabric other than sewn fabric.

The height adjusting mechanism 102 in the fabric printing apparatus 100 of FIG. 10 may be replaced with any other mechanism suitable for adjusting the height of the main platen 104. For example, a screw hole may be formed through the base cylinder 130 and a screw may be screwed therein so that the main platen 104 is fixed at a given height when the screw is tightened while the main platen 104 can be slid up and down along the base cylinder 130 when the screw is loosened.

The vertical distance between the main platen 104 and the inkjet heads 5 in the fabric printing apparatus 100 may be adjusted by moving the inkjet heads 5 in the vertical direction, instead of changing the height of the main platen 104.

The clamp portion 108 of the additional platen 106 shown in FIG. 17 may be replaced with a spring clip so that the additional platen 106 can be detachably attached to the main platen 104.

Although the additional platen 106 shown in FIG. 17 is detachably attached to the main platen 104, it may also be permanently fixed on the main platen 104.

The first and second platens 302 and 304 shown in FIGS. 39A and 39B, respectively, may be provided with identification marks for identifying the type thereof, and the fabric printing apparatus 300 shown in FIG. 38 may be provided with a sensor for reading the identification marks so that the fabric printing apparatus 300 can automatically determine which type of platen is currently attached thereto.

Instead of moving the platen (14, 104) in the auxiliary scanning direction during printing, the fabric printing apparatus according to anyone of the above described embodiments may be arranged such that the inkjet heads 5 move two dimensionally (i.e. both in the main and auxiliary scanning directions) above the platen (14, 104), while the platen (14, 104) is kept stationary, to print a two dimensional image on a fabric supported on the platen (14, 104).

The additional platen 106 shown in FIG. 17 may also be arranged such that it can be attached to the slide base 12 instead of to the main platen 104.

Although various embodiments and modifications are described separately, any suitable combination thereof is also within the scope of the invention.

In the above described embodiments and modifications, the inkjet type fabric printing device is described to print images on T-shirts, pockets of clothes, gloves and socks. It is apparent that the object on which the images are printed need not be limited to those exemplified in the embodiments/modifications, but images can be printed on various fabrics such as a pocket of a bag can be with use of the inkjet type fabric printing device according to the invention.

The present disclosure relates to the subject matters contained in Japanese Patent Applications No. 2003-68271, filed on Mar. 13, 2003, No. 2003-81837; filed on Mar. 25, 2003, and No. P2003-87044, filed on Mar. 27, 2003, which are expressly incorporated herein by reference in their entireties.

What is claimed is:

1. An inkjet type fabric printing apparatus, comprising: an inkjet head that ejects ink onto fabric, the inkjet head reciprocally moving in main scanning direction and auxiliary scanning direction relative to the fabric; a first platen that holds first shape fabric to extend in the main scanning direction and the auxiliary scanning direction to allow the inkjet head to print an image on the first shape fabric; and a plurality of second platens different from each other, that hold second shape fabric which is different from the first shape fabric to extend in the main scanning direction and the auxiliary scanning direction to allow the inkjet head to print an image on the second shape fabric, wherein the plurality of the second platens being detachably and selectably mounted on the first platen.

2. The inkjet type fabric printing apparatus according to claim 1, wherein a reference point is defined on each of the second platen, the reference point serving as an origin for determining a position of an image to be printed on the second size fabric, each of the second platens being configured such that the reference point is located at a fixed point relative to the first platen when the second platen is mounted on the first platen at the same position.

3. The inkjet type fabric printing apparatus according to claim 2, wherein the position on the first platen at which each of the plurality of second platens is to be mounted is indicated with an indication formed on the first platen.

4. The inkjet type fabric printing apparatus according to claim 1, further comprising a sensor system that identifies a type of each of the second platens.

5. The inkjet type fabric printing apparatus according to claim 4, wherein each of the second platens include a portion indicating the type of the second platen.

6. The inkjet type fabric printing apparatus according to claim 4, wherein a location on which an image is to be printed on the second type fabric is determined based on the type of the second platen detected by the sensor system.

7. The inkjet type fabric printing apparatus according to claim 4, wherein a size of an image to be printed on the second type fabric is determined based on the type of the second platen detected by the sensor system.

8. An inkjet type fabric printing apparatus, comprising: an inkjet head that ejects ink onto fabric, the inkjet head reciprocally moving in main scanning direction and auxiliary scanning direction relative to the fabric; a first platen that holds first shape fabric to extend in the main scanning direction and the auxiliary scanning direction to allow the inkjet head to print an image on the first shape fabric; and a second platen that holds second shape fabric which is different from the first shape fabric to extend in the main scanning direction and the auxiliary scanning direction to allow the inkjet head to print an image on the second shape fabric, and the second platen is detachably mounted on the first platen and, the second platen being provided with: (a) a work plate on which the second size fabric is to be set; (b) a mounting portion configured to be detachably coupled to the first platen; and (c) a supporting plate, the work plate being fixed on the mounting portion with the supporting plate placed therebetween, a space being formed between the work plate and the mounting portion, a portion of the second size fabric being received by the space formed between the work plate and the mounting portion.

9. The inkjet type fabric printing apparatus according to claim 8, wherein the supporting plate supports the work plate at an end portion of the work plate.

10. The inkjet type fabric printing apparatus according to claim 9, further comprising a controller that controls the actuation of the inkjet head, wherein the controller allows the inkjet head to start printing only when the sensor has detected the presence of a fabric.

11. The inkjet type fabric printing apparatus according to claim 8, wherein the mounting portion includes a clamping mechanism.

12. An inkjet type fabric printing apparatus, comprising: an inkjet head that ejects ink onto fabric, the inkjet head reciprocally moving in main scanning direction and auxiliary scanning direction relative to the fabric; a first platen that holds first shape fabric to extend in the main scanning direction and the auxiliary scanning direction to allow the inkjet head to print an image on the first shape fabric; and a second platen that holds second shape fabric which is different from the first shape fabric to extend in the main scanning direction and the auxiliary scanning direction to allow the inkjet head to print an image on the second shape fabric, wherein the second platen is detachably mounted on the first platen, and a height adjusting mechanism arranged to support the first platen at a first height and a second height, wherein, when the first platen supported at the first height, the first shape fabric is held at a predetermined distance spaced from the inkjet head suitable for printing, and wherein, when the second platen is mounted on the first platen supported at the second height, the second shape fabric is held at the predetermined distance spaced from the inkjet head.

13. The inkjet type fabric printing apparatus according to claim 12, wherein the second shape fabric is smaller than the first shape fabric.

14. The inkjet type fabric printing apparatus according to claim 12, wherein the second platen is arranged to hold a pocket formed on the fabric.

15. The inkjet type fabric printing apparatus according to claim 12, wherein one end, in the auxiliary scanning direction, of the first platen is formed to have a V-shaped side, at least one of a neck portion and a shoulder portion of the first size fabric being supported by the V-shaped side such that the first size fabric is positioned on the first platen in place.

16. The inkjet type fabric printing apparatus according to claim 12, wherein one end, in the auxiliary scanning direction, of the second platen is formed to have a V-shaped side to allow the second size fabric to be smoothly set on the second platen.

17. The inkjet type fabric printing apparatus according to claim 12, wherein the first platen is provided with an indication that indicates a position on the first platen at which the second platen is mounted.

18. The inkjet type fabric printing apparatus according to claim 12, wherein the height adjusting mechanism includes a supporting member having a first face that supports the first platen at the first height and a second face that supports the first platen at the second height, the supporting member being operable to selectively support the first platen with one of the first and second faces.

19. The inkjet type fabric printing apparatus according to claim 18, wherein the supporting member is a hollow cylinder supported to be rotatable around a center axis thereof, the cylinder having an end face facing the first platen and provided with a notch, and wherein the end face serves as the first face while the notch serves as the second face.

20. The inkjet type fabric printing apparatus according to claim 19, wherein the cylinder is provided with a lever radially extending therefrom, the lever allowing the cylinder to be manually rotated.

21. The inkjet type fabric printing apparatus according to claim 12, wherein the second platen having a clamping mechanism that mounts the second platen on the first platen.

22. The inkjet type fabric printing apparatus according to claim 12, wherein the first platen and the second platen are exchangeable.

23. The inkjet type fabric printing apparatus according to claim 22, further comprising a platen supporting mechanism that exchangeably supports the first platen and the second platen, each of the first and second platens being provided with a shaft extending downward from an undersurface thereof, the platen supporting mechanism including a hollow cylinder that allows the shaft to be detachably inserted thereinto.

24. An inkjet type fabric printing apparatus, comprising: an inkjet head that ejects ink onto fabric, the inkjet head reciprocally moving in main scanning direction and auxiliary scanning direction relative to the fabric; a first platen that holds first shape fabric to extend in the main scanning direction and the auxiliary scanning direction to allow the inkjet head to print an image on the first shape fabric; and a second platen that holds second shape fabric which is different from the first shape fabric to extend in the main scanning direction and the auxiliary scanning direction to allow the inkjet head to print an image on the second shape fabric, wherein the second platen is detachably mounted on the first platen and is configured to have a plurality of platens integrally arranged as a single member, and the first platen and the second platen are exchangeable.

25. An inkjet type printing apparatus, comprising:

an inkjet head that ejects ink onto fabric, the inkjet head reciprocally moving in main scanning direction and auxiliary scanning direction relative to the fabric; a first platen that holds first shape fabric to extend in the main scanning direction and the auxiliary scanning direction to allow the inkjet head to print an image on the first shape fabric; and a second platen that holds second shape fabric which is different from the first shape fabric to extend in the main scanning direction and the auxiliary scanning direction to allow the inkjet head to print an image on the second shape fabric, wherein the second platen is provided with a sensor that detects presence/absence of a fabric on the second platen.

26. An inkjet type fabric printing apparatus, comprising: an inkjet head that ejects ink onto a fabric, the inkjet head reciprocally moving in main scanning direction and auxiliary scanning direction relative to the fabric; a first platen that holds first shape fabric to extend in the main scanning direction and the auxiliary scanning direction to allow the inkjet head to print an image on the first shape fabric; and a plurality of second platens, each of which holds second shape fabric which is different from the first shape fabric to extend in the main scanning direction and the auxiliary scanning direction to allow the inkjet head to print an image on the second shape fabric.

27. The inkjet type fabric printing apparatus according to claim 26, wherein each of the second platens is detachably mounted on the first platen.

28. The inkjet type fabric printing apparatus according to claim 27, wherein the first platen is provided with a plurality of indications that indicate positions, on the first platen, at which respective ones of the second platens are to be mounted.

29. The inkjet type fabric printing apparatus according to claim 28, wherein the multiple marks are arranged in the main scanning direction.

30. The inkjet type fabric printing apparatus according to claim 28, wherein the multiple marks are arranged in the auxiliary scanning direction.

31. The inkjet type fabric printing apparatus according to claim 27, further comprising a height adjusting mechanism arranged to support the first platen at a first height and a second height, wherein, when the first platen is supported at the first height, the first shape fabric is held at a predetermined distance spaced from the inkjet head suitable for printing, and wherein, when the second platen is mounted on the first platen supported at the second height, the second shape fabric is held at the predetermined distance spaced from the inkjet head.

32. The inkjet type fabric printing apparatus according to claim 26, wherein each of the second platens is provided with a sensor that detects presence/absence of a fabric.

33. The inkjet type fabric printing apparatus according to claim 32, wherein the inkjet head is controlled to print images only on the second platens of which sensor has detected the presence of the fabric.

34. The inkjet type fabric printing apparatus according to claim 26, further comprising a controller that operates the inkjet head to execute printing, the controller including a memory for storing images to be printed on fabric set on the second platens, wherein the controller receives a single image from an external apparatus, the controller copying the received image to locations on the memory corresponding to the plurality of second platens, the controller operating the inkjet head according to the data stored in the memory to print the copied images on the fabric set on each of the plurality of second platens.

35. The inkjet type fabric printing apparatus according to claim 34, further comprising sensor systems detecting presence/absence of fabric on each of the second platens the controller copying the received image only to locations on the memory corresponding to the second platens detected, based on outputs of the sensor systems, to hold the fabric.

36. The inkjet type fabric printing apparatus according to claim 26, wherein the first platen is provided with a slit formed between adjacent two of the second platens arranged in the auxiliary scanning direction on the first platen, the slit allowing the fabric set on one of the two second platen to extend down through the slit below the first platen.

37. The inkjet type fabric printing apparatus according to claim 26, wherein the plurality of second platens are arranged at least in the auxiliary scanning direction.

38. The inkjet type fabric printing apparatus according to claim 26, wherein the plurality of second platens include at least one pair of second platens.

39. The inkjet type fabric printing apparatus according to claim 38, wherein the at least one pair of second platens are arranged in the main scanning direction, the at least one pair of second platens having symmetric shapes.

40. The inkjet type fabric printing apparatus according to claim 38, wherein each of the at least one pair of second platens hold a pair of pieces of fabric to be used in pairs.

41. The inkjet type fabric printing apparatus according to claim 40, wherein the pair of pieces of a fabric to be used in pairs including at least one of a pair of gloves or a pair of socks.

42. The inkjet type fabric printing apparatus according to claim 38, further comprising a controller that operates the inkjet head to print images, the controller including a memory for storing images to be printed on the second size fabric, the controller receiving a single image from an external apparatus, the controller copying the received image to a location on the memory corresponding to one of the pair of the second platens while copying a mirror image of the received image to a location on the memory corresponding to the other one of the pair of second platens, the inkjet head being operated, according to the data stored in the memory, to print on the pair of pieces of second shape fabric held by the pair of second platens.

* * * * *